United States Patent [19]

Dennis et al.

[11] 4,309,927

[45] Jan. 12, 1982

[54] CONTINUOUS COLD CUT SLICING MACHINE

[75] Inventors: Edmund G. Dennis, Port Jefferson, N.Y.; Oscar W. Dillon, Essex, Conn.

[73] Assignee: Cashin Systems Corporation, Hauppauge, N.Y.

[21] Appl. No.: 100,547

[22] Filed: Dec. 5, 1979

[51] Int. Cl.[3] ..... B26D 5/20; B26D 7/30

[52] U.S. Cl. ..... 83/77; 83/251; 83/278; 83/367; 83/409

[58] Field of Search ..... 83/77, 206, 251, 262, 83/277, 278, 354, 355, 409, 415, 367

[56] References Cited

U.S. PATENT DOCUMENTS

| | | | |
|---|---|---|---|
| 1,973,919 | 9/1934 | Walter | 83/367 |
| 2,060,540 | 11/1936 | Straeten | 83/355 |
| 2,699,806 | 1/1955 | Gardner | 83/415 |
| 2,752,968 | 7/1956 | Toby et al. | 83/206 |
| 3,129,733 | 4/1964 | Dargan et al. | 83/409 |
| 3,162,226 | 12/1964 | Toby et al. | 83/206 |
| 3,446,499 | 5/1969 | Ringler | 83/251 |
| 3,605,538 | 9/1971 | Bohmer et al. | 83/206 |
| 3,820,431 | 6/1974 | Peddinghaus | 83/278 |
| 3,880,295 | 4/1975 | Wyslotsky | 83/409 |
| 4,015,494 | 4/1977 | Spooner et al. | 83/409 |
| 4,060,875 | 12/1977 | Gosling et al. | 83/278 |

*Primary Examiner*—James M. Meister

*Assistant Examiner*—K. Bradford Adolphson

*Attorney, Agent, or Firm*—Kane, Dalsimer, Kane et al.

[57] ABSTRACT

A continuous cold cut slicing system utilizing a slicing machine having a conveyor which feeds a loaf into engagement with a series of drums located on each side of the slicing machine channel; said drums are driven by a variable speed motor with the rotation of the drums providing a feed mechanism of the product to the slicing blade. A gripper assembly is provided which rides on guide shafts adjacent said channel with the movement of the gripper in the channel constantly being monitored by an encoder connected thereto and positive drive is supplied to the gripper towards the blade by a clutch means in conjunction with a rack and pinion arrangement. The positive drive may be synchronized with the feed of the drums. As the gripper approaches the knife, the drag may be placed on the gripper thereby compensating for pull of the blade. Also, since the encoder is constantly monitoring the position of the gripper, the exact location of the tail end of the loaf being sliced is readily determinable so that the profile compensation control system may be effectively incorporated into the system. Upon completion of slicing of a loaf, the drive of the product ceases, the gripper is retracted and during the short interval and an automatic tare correction system may be activated so as to compensate for scraps or grease on the weighing apparatus.

25 Claims, 21 Drawing Figures

CONTINUOUS COLD CUT SLICING MACHINE

BACKGROUND OF THE INVENTION

The present invention relates to improvements and apparatus for slicing food products and arranging them in a stacked form of controlled weight; apparatus of this type is disclosed and commonly assigned U.S. Pat. Nos. 2,903,032, granted Sept. 9, 1959, 3,099,304, granted July 30, 1963, 3,200,864, granted Aug. 18, 1965, 3,204,676, granted Sept. 7, 1965, 3,835,742, granted Sept. 17, 1974, 3,864,957, granted Nov. 12, 1974, 3,864,958, granted Nov. 12, 1974, 3,880,035, granted Apr. 29, 1975, 3,905,259, granted Sept. 16, 1975, 3,906,823, granted Sept. 23, 1975, 3,910,141, granted Oct. 7, 1975, 3,933,066, granted Jan. 20, 1976, 4,015,494, granted, Apr. 5, 1977, U.S. patent application Ser. No. 849,528 filed Nov. 7, 1977, abandoned in favor of continuation-in-part Application Ser. No. 92,195 filed Nov. 6, 1979 and U.S. patent application Ser. No. 92,665 entitled Continuous Cold Cut Slicing Machine, filed Nov. 9, 1979, commonly assigned herein.

While apparatus of the type disclosed in these patents have proven to be satisfactory, it is desirable to upgrade their operation and efficiency and provide for improved continuous operation of such systems with the maximum amount of slicing of products and integrity of stack being realized. In addition, it is also desirable to maintain an improved control over the product being sliced throughout the slicing cycle thereby preventing the throw-off or splattering of product resulting in disruption of weighing process and inconsistency in stack weight.

Usually, in the conventional machines, the approach is to have a tractor metering feed belt throughout the entire length of the channel bed, with various hold-down devices incorporated to effectively control the loaf against pull by the blade and rotation as it is being sliced. Included therewith usually is a gripper assembly which utilizes vacuum suction and grips the tail end as a means of removing the butt end before it is splattered by the knife. The use of tractor metering feed is expensive, and in addition does not provide the most effective control of the slice, allowing splattering of the loaf which interferes with the weighing of the product, as aforementioned. This necessitates the cleaning of the machine on a relatively frequent basis thereby inhibiting the effective operation of a continuous machine.

In such conventional systems, the usual timer per slicing of a loaf is approximately 28 to 30 seconds, with a 10 second period necessary for retracting the gripper so that the next succeeding loaf could pass on to be fed into the slicing blade. The retraction time of the conventional systems is approximately $\frac{1}{3}$ of the cutting time, and efficiency is lost due to idleness of the machine during this period.

In commonly assigned application Ser. No. 92,665 entitled Continuous Cold Cut Slicing Machine, there is disclosed a means of providing a free wheeling gripper assembly which serves to improve slicing operation. While the system can effectively provide for continuous slicing, it has become desirable to provide additional features thereon to improve its operation.

Also, incorporation of the profile compensation control system, as disclosed in the U.S. patent application Ser. No. 92,195 in the present system, while effective, is improved through the use of a means of determining in the exact location of the tail end of the loaf being sliced, to provide accuracy in determining when the rear count should begin.

SUMMARY OF THE INVENTION

Accordingly, it is a principal object of the present invention to provide for an improved means for continuously operating a cold cut slicing machine while providing a controlled feed of the product adjacent the blade preventing loss of product and splattering.

It is a further object to provide for such continuous operation utilizing a positive drive means for the gripper assembly along with a rack and pinion assembly to convey the same while allowing the monitoring of the gripper assembly position, all of which provides improved cutting and retracting operation.

Another object is to provide for an improved slicing machine which will effectually allow for the incorporation of the profile compensating control system while in addition being capable of providing, during continuous operation of the system, a period where the automatic tare correction control system may also be utilized.

With regard to the foregoing, the present device provides for a continuous cold cut slicing system which utilizes a slicing machine which allows for improved continuous and controlled product feed to a point close to the knife thereby preventing loss of product and integrity of the stacks. The product is initially feed to a conveyor which feeds the loaf into engagement with a series of drums, located on each side of the slicing machine channel. These drums are driven by a variable speed motor, responsive to standard slice thickness control, with the rotation of the drums providing a feed mechanism of the product to the blade.

The gripper and carriage is then driven towards the trailing end of the loaf being sliced until said gripper engages said end. While this may be accomplished by the abutment of the next succeeding loaf with the carriage, it is advantageous to utilize a positive driving means, to quickly move the gripper into said engagement. This would make it independant of the conveyor speed driving the next loaf which may be subject to slippage.

This positive drive would continue beyond the drums at a rate synchronized with the drum feed speed.

The drive provided to the carriage and gripper assembly may be communicated thereto by way of a rack and pinion arrangement, which also would provide a means of monitoring the movement of said assembly by its interconnection with an encoder means. A reverse clutch could also be connected to the rack so as to allow retraction of the gripper upon completion of the slicing cycle. In addition, a biasing of the gripper assembly may be provided via a clutch arrangement, also interconnected to the gripper via the rack, so as to induce a predetermined drag on the gripper assembly as the trailing end of the loaf approaches the blade.

The mechanics of operation would allow for the operator to initially determine the biasing or drag necessary for the particular product being sliced. This could be set by way of a potentiometer or switch arrangement so as to increase or decrease the biasing as necessary. In addition, two additional clutch arrangements would be provided to provide alternatives in the amount of drive of the gripper towards the blade. These clutch arrangements would be connected to the driving motor for the drums so that sliced thickness control is maintained since it operates to maintain the speed of that motor. Of course, if so desired, a separate motor for the gripper assembly may be utilized and similarly connected to the sliced thickness control apparatus.

The driving clutch arrangement could provide the operator with a number of alternatives in driving the gripper assembly. In this regard, two of the clutches could provide 150% and 100% of the drive speed relative to the speed of the feed of the drums. The 150% clutch would be activated to drive the gripper assembly, once it is in the channel, quickly towards the trailing end of the loaf. Once the gripper assembly engages the trailing end of the loaf, and has gone beyond the control of the feed of the drums adjacent the blade, the 100% clutch would then engage and take over operation, and drive the loaf toward the blade at the same speed that the drums would have. This would not, however, compensate for the pull of the knife so that, depending upon the product, the operator would select appropriate biasing or drag to be placed upon the gripper assembly via a clutch arrangement once the trailing end of the loaf has passed beyond the control of the drums adjacent the blade.

In addition, since the encoder is constantly monitoring the position of the gripper and carriage, the exact location of the tail end of the loaf being sliced is readily determinable so that the profile compensation control system may be effectively incorporated to provide for adjustments of the machine to accommodate the common tapers on the front and back end of the loaf.

Once the slicing is completed, for approximately three seconds, the drive motors for the drums and conveyor are disengaged and the gripper and carriage assembly are removed from the channel and retracted, with the next succeeding loaf then being fed quickly into the knife. Depending on the gripper used, this may necessitate moving the drums slightly out of the channel which is provided for. During this time the weighing apparatus may be signaled so that the automatic tare correction system may be activated to compensate for any scraps or grease on the weighing apparatus.

Since the retraction of the gripper and carriage assembly is not the length of the channel, but rather a mere portion thereof, such retraction time is only approximately three seconds as compared to the conventional ten seconds thereby allowing somewhat continuous slicing of the product without idle time for the machine. By the use of such a system, the automatic tare correction system and profile compensation control system may be incorporated in the machine in a most effective manner not heretofore realized.

Other objects and advantages will become apparent from the following detailed description of which is to be taken in conjunction with the accompanying drawings.

DETAILED DESCRIPTION OF THE DRAWINGS

Figure 1A:
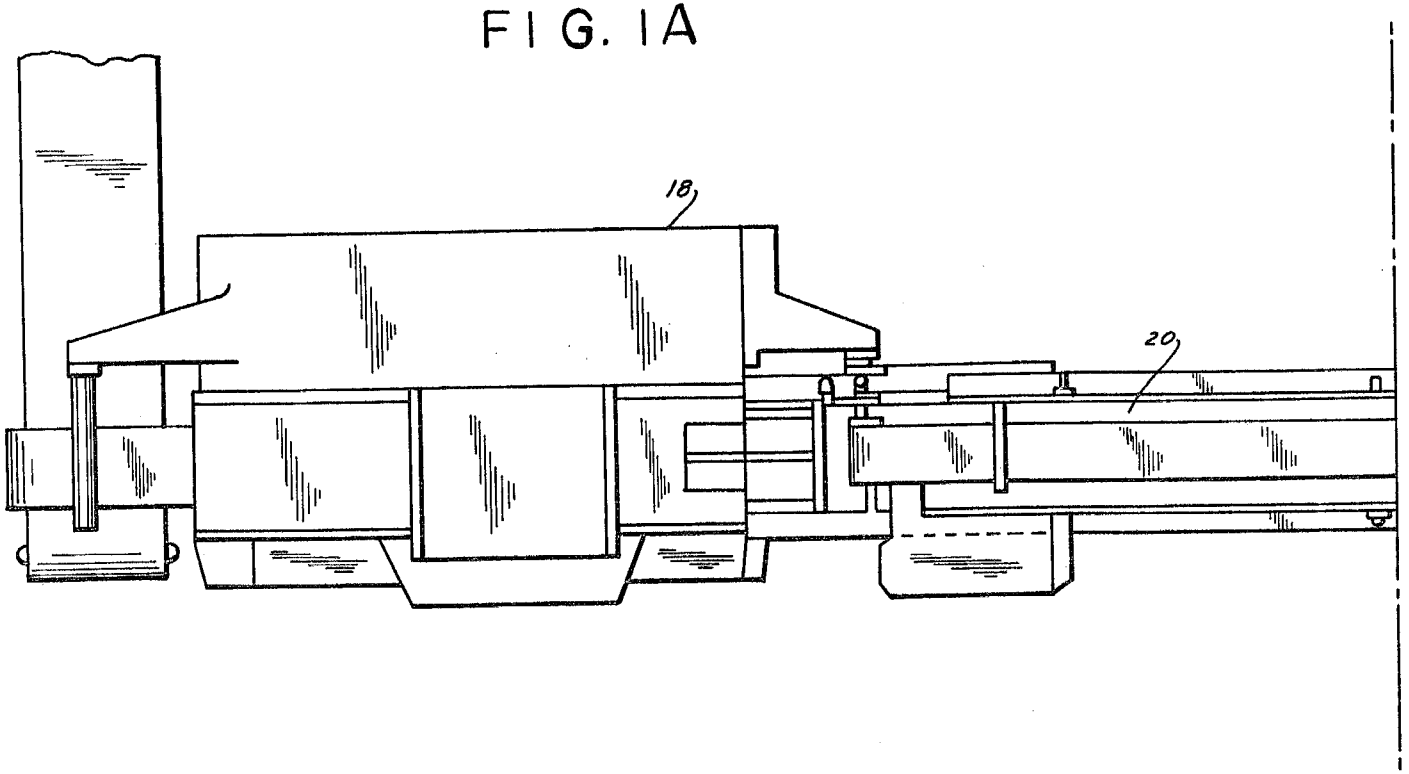
FIG. 1A and 1B depict a top plan view of the system incorporating the teachings of the invention.
Figure 1B:
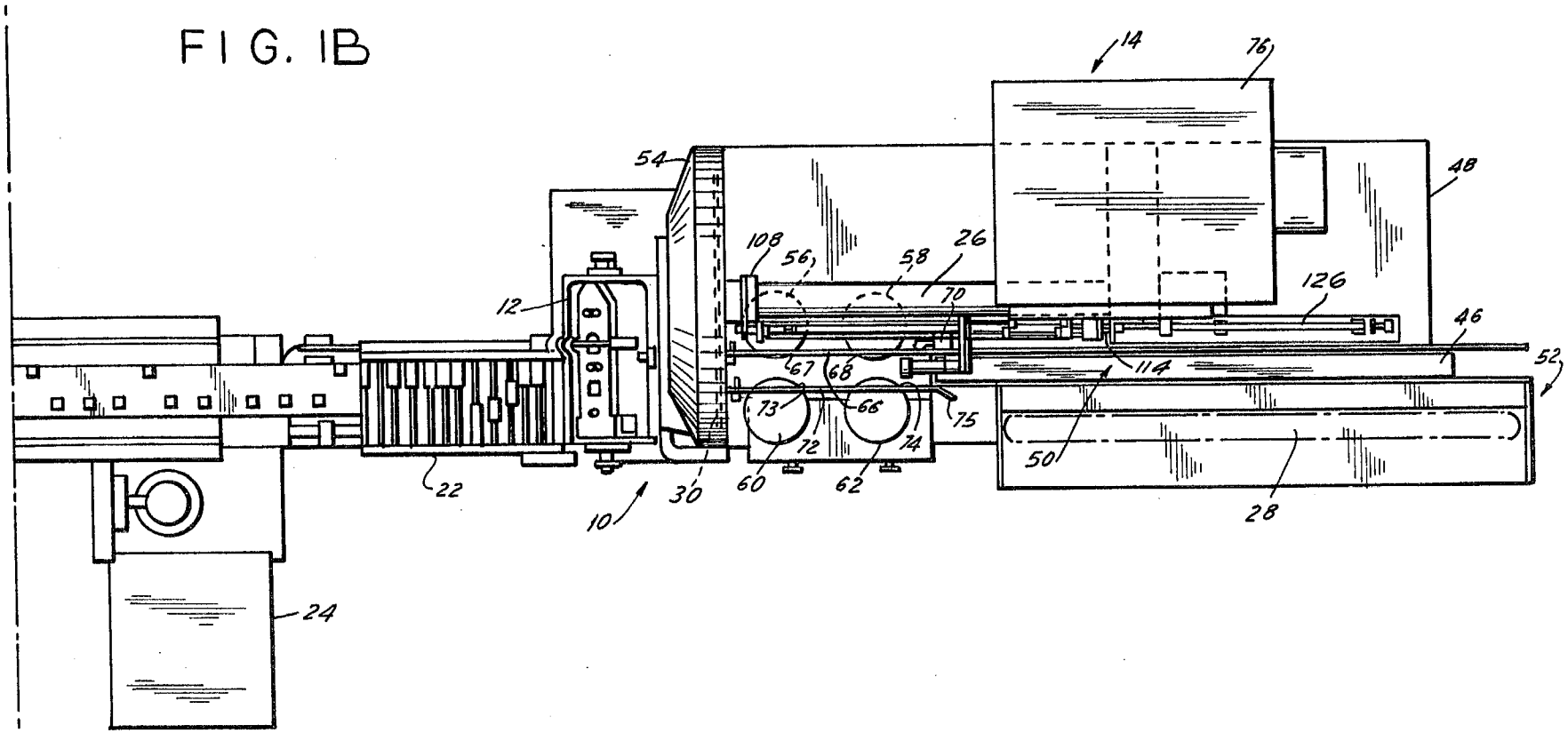

Referring now to FIGS. 1A through 2B, there is shown an entire meat slicing, weighing the packaging system. The system includes a weighing while-conveying-apparatus 10 and a stacker 12 shown at the discharge end of a slicing machine 14. The slices produced by the slicing machine, are discharged onto the stacker and from there as a stack or batch onto a conveyor 16 of the weighing while conveying apparatus 10. The stack is then transferred to a packing station 18 by a transverse conveyor 20, if it is of the correct weight, as determined by the weighing apparatus 10. If not, the stack is moved by an interposed rejection conveyor 22 to make-weight station 24 at which point the proper weight is made.

STACKER

The drawings illustrate one type of stacker which may be utilized in the system, however, it should be understood that the illustrated stacker does not per se constitute the present invention. The stacker 12 shown is usually driven in a time relationship with the knife shaft 26 of the slicer 14, and receives slices of the product 28, collects them in a stack, and after the slicing blade 30 has cut the last slice, deposits the stack on the conveyor 16 of the weigh by conveying apparatus 10. This type of stacker is disclosed in U.S. Pat. No. 3,200,864 and 3,204,676 as well as the references incorporated therein. If so desired, a dual speed version of this type of stacker, as disclosed in the U.S. Pat. No. 3,933,066 may be utilized in its place.

A yet further option may be the use of the stacker of a type located on the weighing apparatus of the system, as shown in U.S. Pat. Nos. 3,835,742; 3,905,259 and 3,906,823 and the references incorporated therein. This of course allows for incorporating the various inventive features as disclosed by each of said patents into the system by way of modifications to the associated apparatus, as discussed in the respective patents. In this regard, for example, the interrelationship between the weighing apparatus and the slicing machine so as to provide slice thickness control may be utilized as discussed in the aforenoted patents. This is usually accomplished by way of interconnecting the scale 32 of the weighing apparatus to a servo mechanism which accepts signals from the scale to adjust the speed of the feeder of the product 28 to be sliced to the blade 30. This is discussed, for example, in U.S. Pat. No. 3,200,864 where the stacker is located on the slicing machine, or in the case where the stacker is located on the weighing apparatus, as described in U.S. Pat. No. 3,835,742. In either case, slice thickness control is usually accomplished by adjusting the feed of the loaf into the slicer, wherein the slice thickness control is coupled to the feeder or driving means to increase or decrease the rate of speed and consequently decrease or increase the slice thickness. This control is usually automatically adjusted in response to a feedback signal from the weighing apparatus as discussed for example in U.S. Pat. No. 3,200,864 Column 3, line 1-36; Column 4, lines 3-39, 74-75; Column 5, lines 1-26; Column 7, line 36-Column 8, line 28; Column 11, line 65-Column 13, line 65; U.S. Pat. No. 3,204,676; Column 11, line 70-Column 12, line 14; Column 13, line 1-Column 14, line 74; U.S. Pat. No. 3,835,742, Column 3, lines 23-68; Column 4, lines 1-2; and U.S. Pat. No. 4,015,494, Column 4, line 4-Column 5, line 20 set forth examples of representative circuitry and means to control slice thickness.

WEIGHING APPARATUS

During operation of the system the slices of the product 28 are stacked on the receiving paddles of the stacker until a preselect number of slices have been deposited therein at which time the paddles are accuated to transfer the stacked sliced product onto the weighing apparatus 10. The conveyor 16 of this assembly is constantly driven by a motor which, through the operation of circuitry as described for example in U.S. Pat. No. 3,200,864, is adapted to operate at low speed of travel of the conveyor during the depositing of the sliced stacks thereon by the stacker, and an increased speed in order to remove the weighed stacks therefrom in minimum time.

The conveyor 16 is conveniently mounted so as to accuate a scale 32 following reception of the stack of sliced products to be weighed. The weighed stack is then transferred onto the reject conveyor 22 at which point those stacks within the correct weight tolerance will pass to the transverse conveyor 20. Those stacks, not of proper weight, will be pushed or shifted aside by means of the reject conveyor in accordance with signals transmitted by the scale 32. The stacks of proper weight, are then taken to the packaging station 18, while stacks of improper weight are corrected and eventually similarly directed.

In usual operation, the scale 32 will generate a pulse when registering those stacks outside of the prescribed limit, which may be transferred to a servo mechanism utilized to adjust the slice thickness thereby correcting whatever error may be present in the stack weight. The mechanics of this may be such as that aforenoted or by other means suitable for purpose.

Of course in the case of those systems wherein it is desired to have the stacker mounted on the weighing apparatus, the operation and the advantages of this type of an arrangement may be incorporated into the system as set forth in those patents previously mentioned which provide for such an arrangement.

In the illustrated weighing apparatus 10, the weight conveyor 16 is mounted on a scale 32 contained in a housing 34 having a hinged door 36 and legs 38. A tubular support 40 couples the weigh conveyor 16 to the scale 32. Under such circumstances, the stacked weight on the conveyor 16 will be transferred through the tubular support 40 to the scale 32 in a manner similar to that disclosed in U.S. Pat. Nos. 3,200,864 and 3,835,742. Again, it should however be realized, that the weighing apparatus us does not per se constitute any part of the present invention; and one of the commercially available scales may serve the intended purpose.

However, it is desirous that the scale utilized in the present system be equipped with a tare correction system as disclosed in U.S. patent application Ser. No. 92,195 filed Nov. 6, 1979, commonly assigned to the present applicant. As disclosed by said application, as well as the references incorporated therein, the weighing apparatus would be equipped with a means of automatically correcting the control weight setting of the scale to compensate for any scraps or grease built-up on the scale during operation. This may be accomplished by periodically dropping a control weight on the scale each time the slicing machine is in an inoperative or return cycle, with control circuitry to reset the scale null. The point to where it resets depends upon a comparison of the weight on the scale in a predetermined control weight setting. In this manner the build-up or grease on the weight conveyor does not affect the weight of the stack, this is taken into account periodically and the correction is made. In this regard, and as disclosed in said application, a solenoid means 42 is provided which is responsive to a signal eminating from the slicing machine, as later discussed, which will periodically lower and raise a predetermined weight 44 onto an extension 45 of the tubular member 40 so that the scale may be adjusted as aforementioned.

SLICING MACHINE

The slicing machine 14 may be any one of the several different type of slicing machines presently being used in the cold cut slicing industry, with the modifications as hereinafter discussed. The basic slicer may be that of the type disclosed in the above referenced patents and one which is commercially available in a system manufactured under the name Anco, No. 1432 Cold Cut Slicing and Weighing System, manufactured by Chemetron Process Equipment, a Division of Chemetron Corporation P.O. Box 35600 Louisville, Ky. 40232. In a usual machine of this type, a conveyor or feeder 46 shifts forwardly thereby pushing the loaf 28 of the selected product towards the slicing blade 30. Usually, a slice thickness control mechanism is coupled with this feeder to increase or decrease the rate of travel of the feeder and consequently decrease and increase the slice thickness respectively. Also, the control mechanism and appropriate circuitry may be automatically adjusted in response to a signal from the scale 32 as aforementioned. Operation of the slicing machine 14 is similarly connected with the weighing apparatus to that discussed in the aforementioned patents, however, the drive for the drums is interconnected thereto rather than the conveyor or feeder 46, as later discussed. The modifications of the machine provide for an improved and somewhat continuous cold cut slicing operation.

As shown, the slicing machine includes a supporting table 48 having a channel or bed 50 running the length of the machine to receive the loaf 28 to be sliced. A feed conveyor 46 is provided in a mere portion of the channel rather than its full length. This conveyor initially receives the loaf 28 which is fed on the conveyor by way of a ramp feed 52, discussed more fully later.

The slicing machine, as aforementioned, includes a knife 30 contained in a knife housing 54 located at the discharge end of the slicing machine. Adjacent the knife housing is provided four drum drivers 56, 58, 60 and 62, with two located on each side of the channel in a parallel arrangement so as to engage the opposite sides of the loaf as it passes therethrough. These drums may be made of plastic and have a ribbed circumference to engage the loaf. Since the conveyor 46 does not run the entire length of the channel, a function of the drum drivers will be to feed the loaf into the knife after the loaf has left the conveyor. The channel bed 64 adjacent the drums may be relatively smooth since a frictional engagement of the loaf with the bed in this area is not necessary, due to the driving of the drums.

A channel wall 66 is provided throughout the length of the channel and may be integrally constructed with suitable openings 67 and 68 to allow a portion of drum 56 and 58 respectively to pass therethrough to engage the loaf in operation. This channel wall would be of a fixed nature and would, have an opening for a product detector switch 70 whose operation will be later discussed. Adjacent the housing is a second channel wall 72 which terminates short of the ramp feed 52 so as to allow the feeding of the loaves 28 onto the conveyor 46. The channel wall 72 similarly includes appropriate openings 73 and 74 for drums 60 and 62 respectively so as to allow them to engage the loaf during operation. In addition, the wall 72 has a flared portion 75 which facilitates the entry of the loaf into this section of the channel.

The drum 60 and 62 are movable and of an adjustable nature, as later discussed, so as to allow variation of the channel width to accommodate the varying width of different types of cold cut loaves, while also allowing use of various type grippers which may require more channel width when the gripper moves between its up and down position. Thus, the slicing machine may be utilized for different shaped loaves and different type grippers with minimal adjustments.

The slicing machine is also provided with a housing 76 which would contain all of the control circuitry for operation of the machine. Circuitry contained therein would include that standard to the operation of the system as disclosed in the aforementioned patents, and in addition would include circuitry to provide the profile compensation control system as disclosed in Ser. No. 092,195 aforementioned, which may be advantageously included to accommodate the common tapers on the front and back end of the loaf. In this regard, as hereinafter discussed, many aspect of the present invention provide for an improvement of such a system due to its ability to keep a constant monitoring of a location of the tail end of the loaf being sliced and the front end of the next succeeding end of the loaf.

In this regard, in the drawings, the slicing machine is provided with a loaf gripping assembly 78, and as illustrated, having a suction cup 80 to grip the end of the loaf when it is in the channel. Of course, if so desired, a variety of other grippers possibly a mechanical i.e. claw gripper, rather than vacuum type may be readily incorporated into the system. Connected to this suction cup 80 would be a source of vacuum (not shown) which may be that standardly used on presently commercial slicing machines. The suction cup 80 is supported by a gripper carriage 82 which includes a rectangular plate 84 having two plates 86 and 88 mounted thereunder, each having two parallel circular bearings 90, 92, 94, 96, which ride on guide rails or shafts 100 and 102 which run parallel to the channel. These shafts terminate at their ends in keyed portions which are fixedly mounted in support blocks 104 and 106. These support blocks are in turn supported by braces 108 and 110 via bearing elements 112 and 114 respectively, which allow free rotation of the blocks thereabout during tilting of the carriage, here discussed.

Since the suction cup 80 is intended to grip the loaf in the channel and then withdraw when slicing is completed, as later discussed, it is necessary that the carriage be capable of moving from a raised or upward position so as to allow the loaf to pass through, and then into a lowered or down position, so that the suction cup may grip the trailing end of the loaf.

In this regard, and as clearly shown in FIGS. 3–7, a tilt mechanism 116 is provided to move the carriage between these two positions. This includes having a cylinder 118, mounted on the support brace 110 by way of a pivot pin 120, while being pivotly connected, via pin 122, to a tilt plate 124 which engages the guide shafts 100 and 102.

A rack 126 is fixed to the carriage terminating short of its forward end and mounted so as to allow rotation of the carriage when the carriage is tilted, while maintaining the rack rotatably fixed. This may be accomplished by axially alligned rotational bearing 128, which engage the rack 126, transferring axial displacement of the carriage thereto, while being rotatable in the corresponding bore 130 through plate 88.

Figure 5:
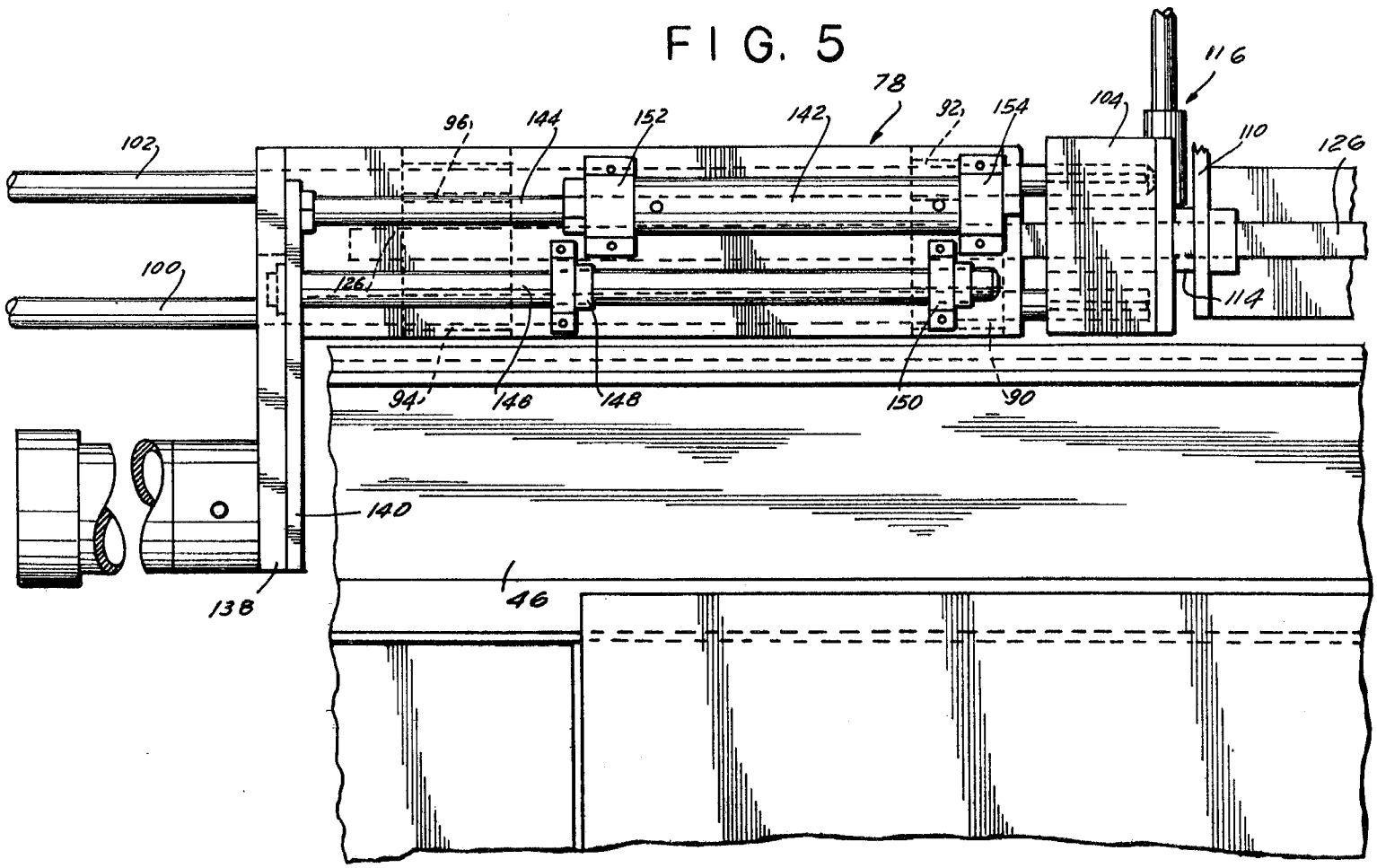
FIG. 5 is a horizontal sectional view along lines 5—5 of FIG. 4 with the carriage in its maximum rearward position.
Figure 6:
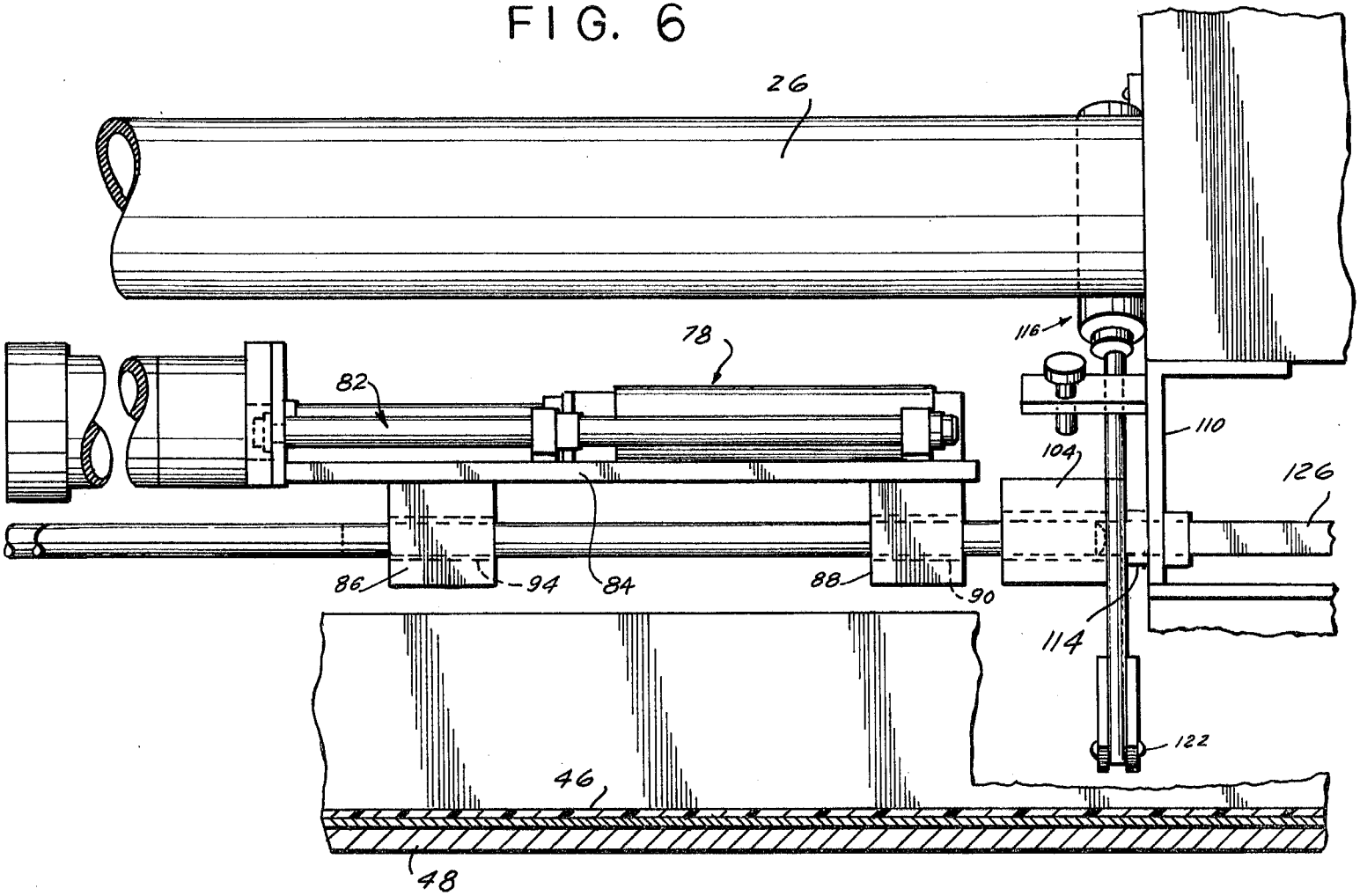
FIG. 6 is a vertical sectional view along lines 6—6 of FIG. 4 with the carriage in its maximum rearward position.
Figure 7:
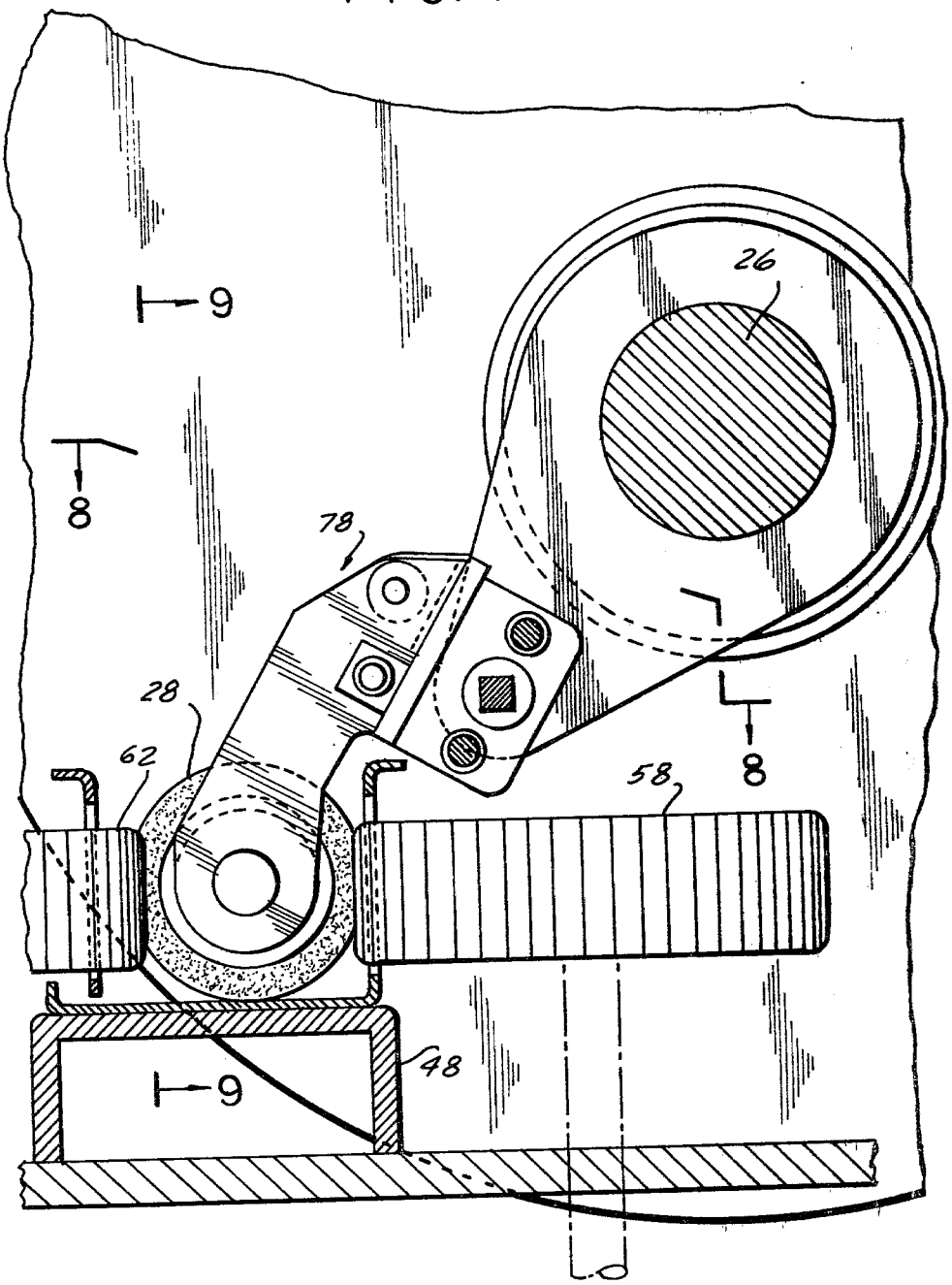
FIG. 7 is a sectional view along lines 7—7 of FIG. 2B with the carriage shown in its lowered and forward position.

Also in this regard, bearing 114, seen most clearly in FIGS. 5 and 6, is interposed through a support brace 110, the tilt plate 124 and support block 104. The bearing should have an internal diameter sufficient to allow the rack to pass there through during operation.

Since the carriage is mounted on the two guide shafts, a rotational force on the tilt plate 124 causes corresponding rotation of the shafts and carriage when the piston is activated. This would result in the tilting of the carriage and gripper assemble between an up and down position.

When tilted to a down position, a threaded stop 134 is positioned so as to abut the block 104 thereby limiting the extent of rotation of the carriage and gripper assembly. This is helpful in adjusting the displacement of the gripper in the channel which may vary due to the particular type gripper utilized.

In addition, located adjacent the support block 106 is an adjustable forward stop 136. During operation, when the gripper is at its closest point to the knife, this stop abuts the furthest end of the rack 126, preventing accidental engagement of the gripper with the knife. This stop may be adjusted so as to accommodate the various sizes of grippers which may be utilized.

As later discussed, the cylinder to tilt the carriage may be activated by the product detector switch 70 and the encoder arrangement via controlled circuitry. Also, the cylinder 118 may be of the pneumatic, hydraulic or solenoid type if so desired.

The gripper assembly includes a suction cup 80 as aforementioned, which is supported by an extending arm 138 attached to the rectangular plate 84 of the carriage so as to allow the suction cup to extend into the channel during operation. Located adjacent to the extending arm 138 is a pusher plate 140 whose position is varied during operation, with this being regulated by way of a cylinder 142 having its piston 144 connected to said plate. Movement and support of said plate 138 also is provided by way of a rod 146 connected thereto, with said rod being mounted on the rectangular plate of the carriage by way of bearing mounts 148 and 150. The cylinder 142 is mounted on the carriage by way of mounts 152 and 154 and, during operation, as later discussed, is adapted to receive a signal so as to vary the position of the pusher at appropriate times during the operation of the machine.

With particular regard to the rack and pinion arrangement, as shown in FIGS. 15–18, the rack 126 is connected at one end to the carriage with its opposite end supported by a roller 156 which is intended to move along a flat surface or track of the table 48. Intermediate the carriage and roller ends is a support block 158 which allows the rack to move therethrough while providing support to prevent bowing or misallignment of the rack. The rack is shown to have a plurality of notches intended to engage gear or pinion 160 which is mounted on shaft 162 and may be rotationally mounted on the table 48. Also located on the shaft is gear 164 which via belt 166 is connected to a clutch 170 via gear 172 and shaft 174. This clutch 170 may be the magnetic particle type and functions to ramp up and ramp down the drive of the carriage while providing the desired drag or biasing as necessary, as later discussed, and is conveniently mounted on the under part of the table. Shaft 175 terminates on its opposite side in a gear 180 which, via belt 182 is interconnected to the drive means, as later discussed. It should be understood that when using the term gear and belt herein, these are intended to include all forms of gears, friction and sprocket type; chain link belts and other means of conveying power etc. respectively.

The opposite end of shaft 162, terminates in the encoder assembly 184 mounted on the table 48, which may be a potentiometer arrangement as discussed in the aforementioned application entitled Continuous Cold Cut Slicer.

The movement of the carriage would cause movement of the rack which in turn causes a rotational displacement of gear 160 which is transmitted to the encoder 184 via shaft 162. The change in the displacement of shaft 162 can be used to monitor the position of the carriage at all times. Also, positive drive to gripper may be supplied via clutch 170 and the belt and gear arrangement shown in FIG. 16 already described, and later discussed.

When the carriage is retracted, it may be desirable to provide an adjustable rear limit stop or damper 186 which is spring loaded 80 as to provide a somewhat cushioning effect on the returning rack.

Figure 2A:
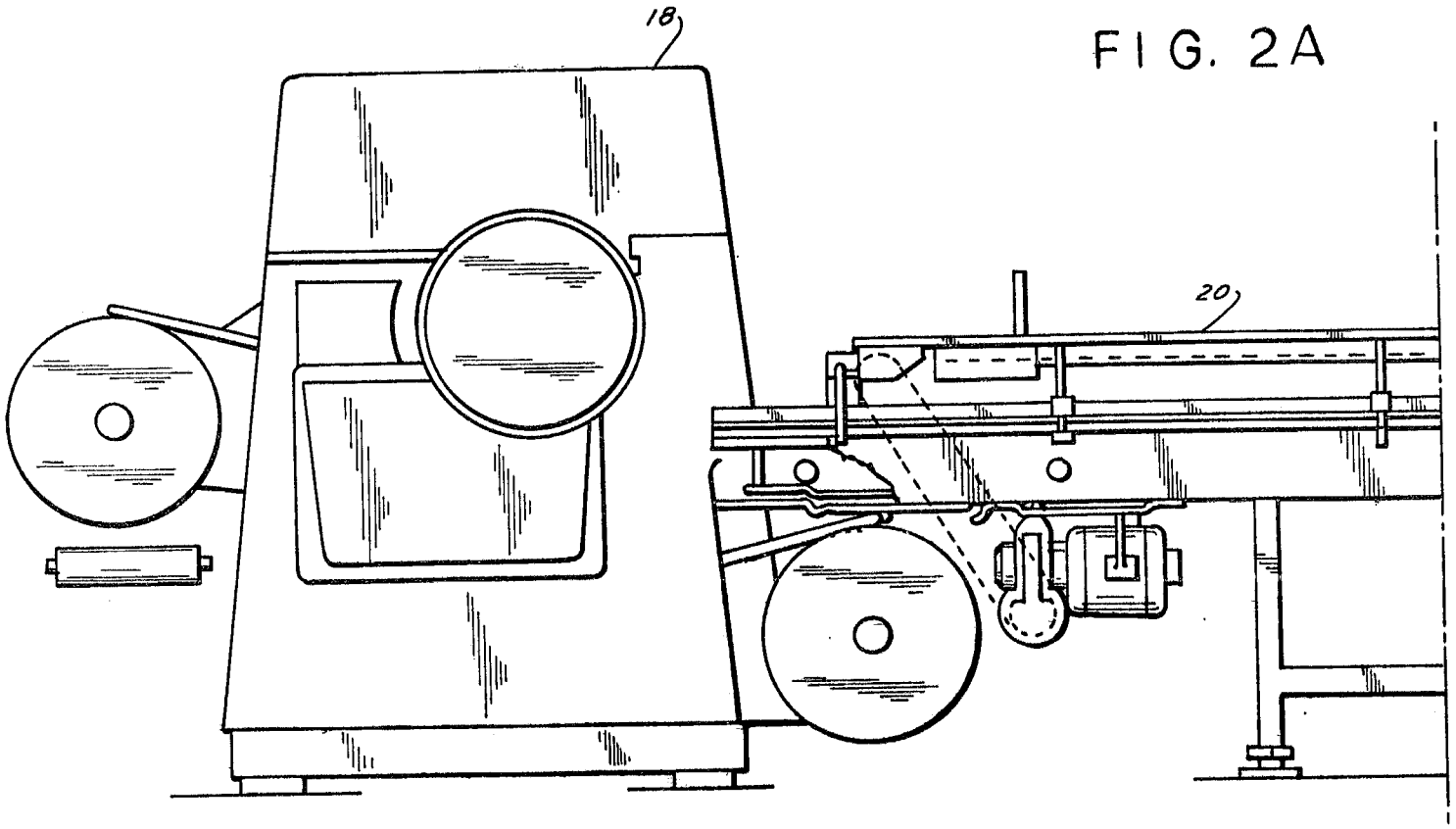
FIGS. 2A and 2B depict a side elevational view of the system incorporating the teachings of the invention.
Figure 2B:
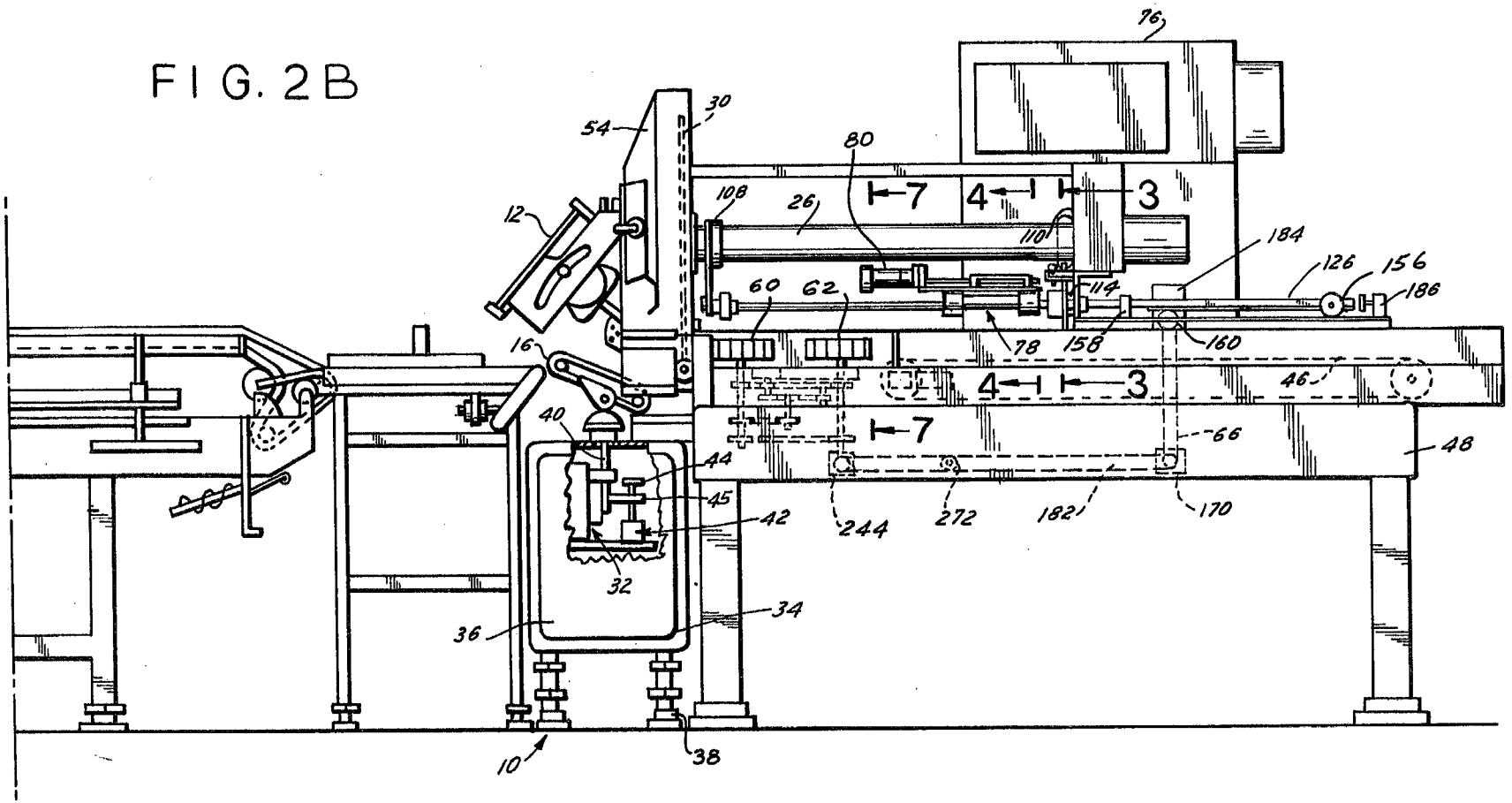
Figure 3:
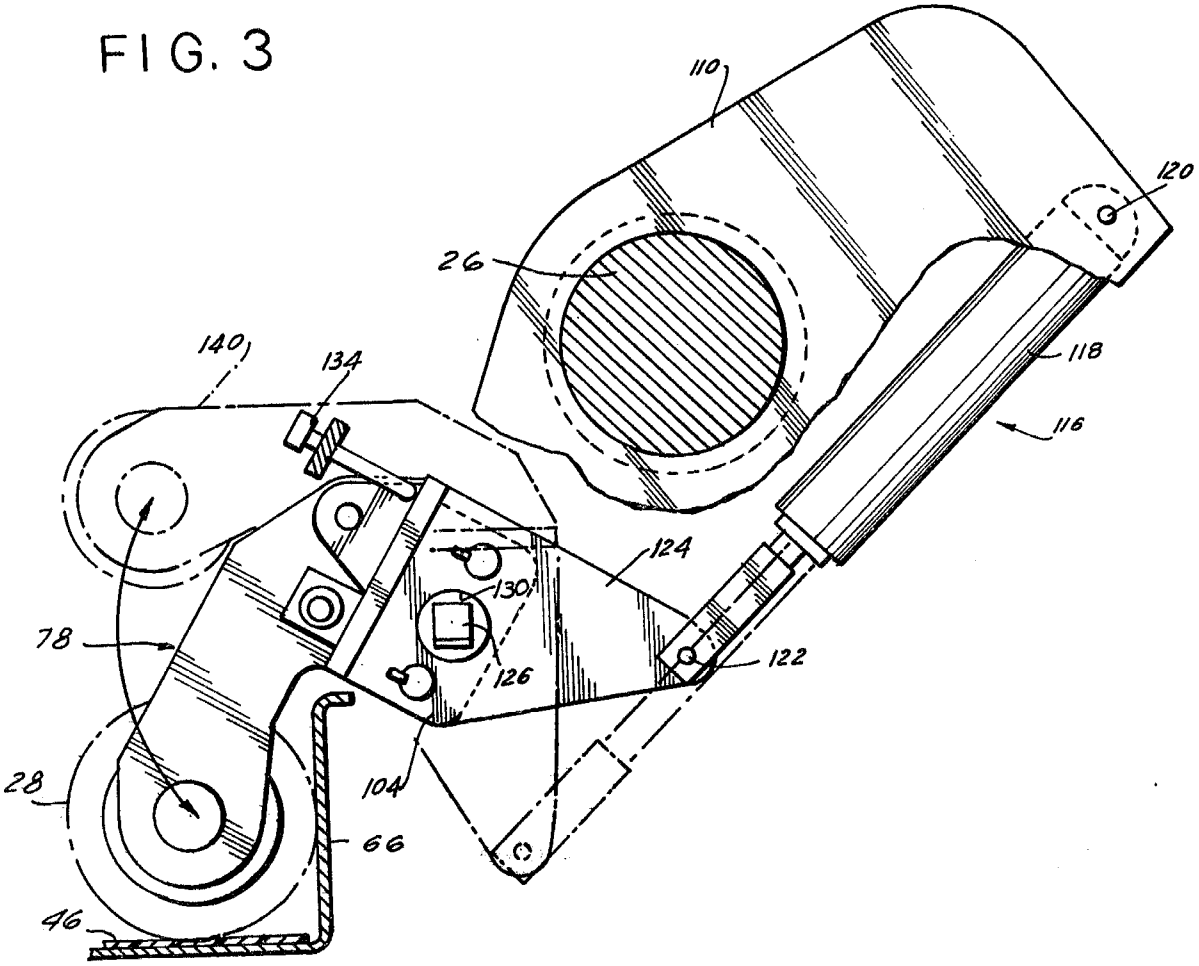
FIGS. 3 is a sectional view along lines 3—3 of FIG. 2B showing the carriage tilt mechanism.
Figure 15A:
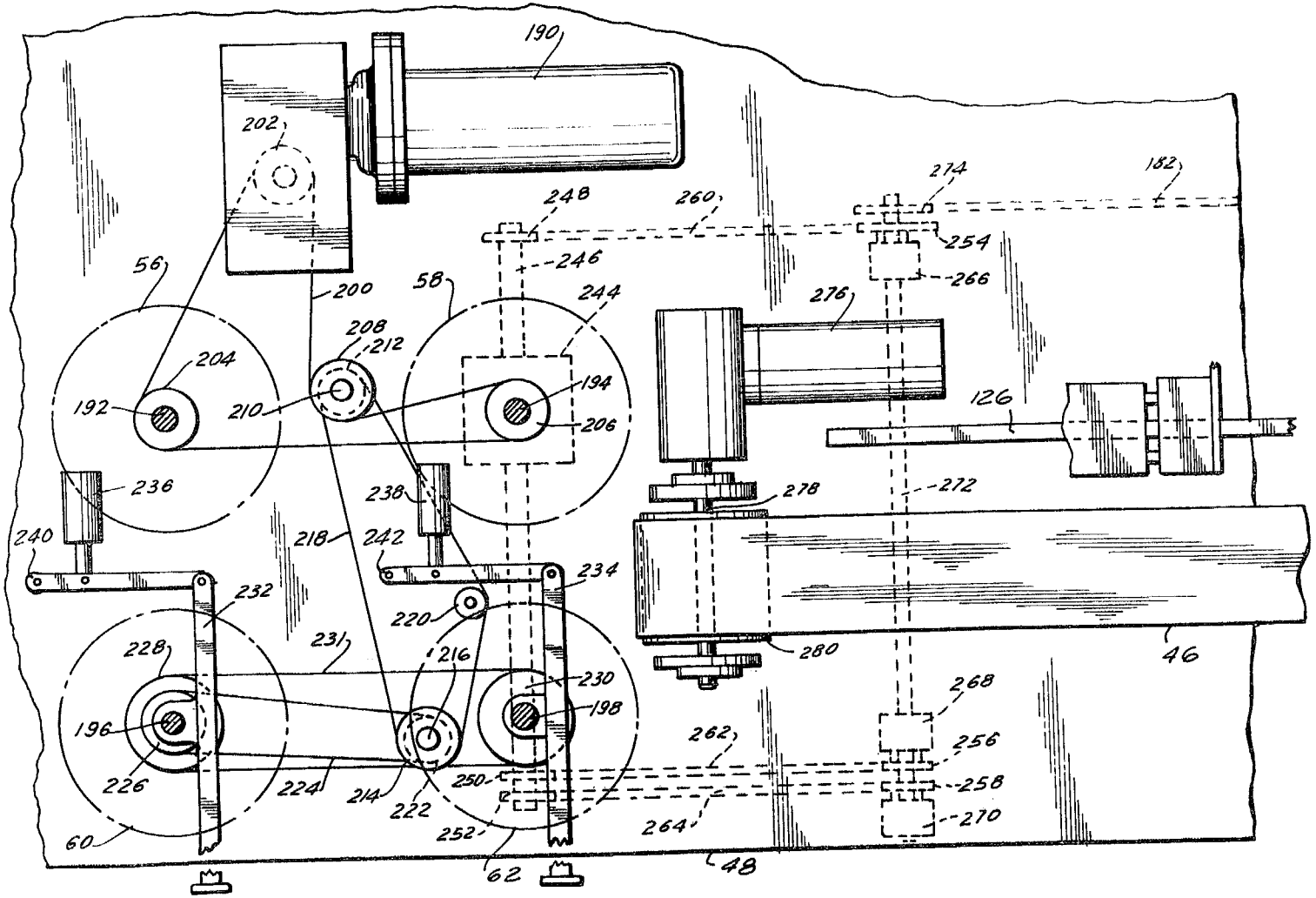
FIGS. 15A and 15B depict a plan view of the drive means for the slicing machine including the drive motors and clutches gear and linkage arrangement.
Figure 15B:
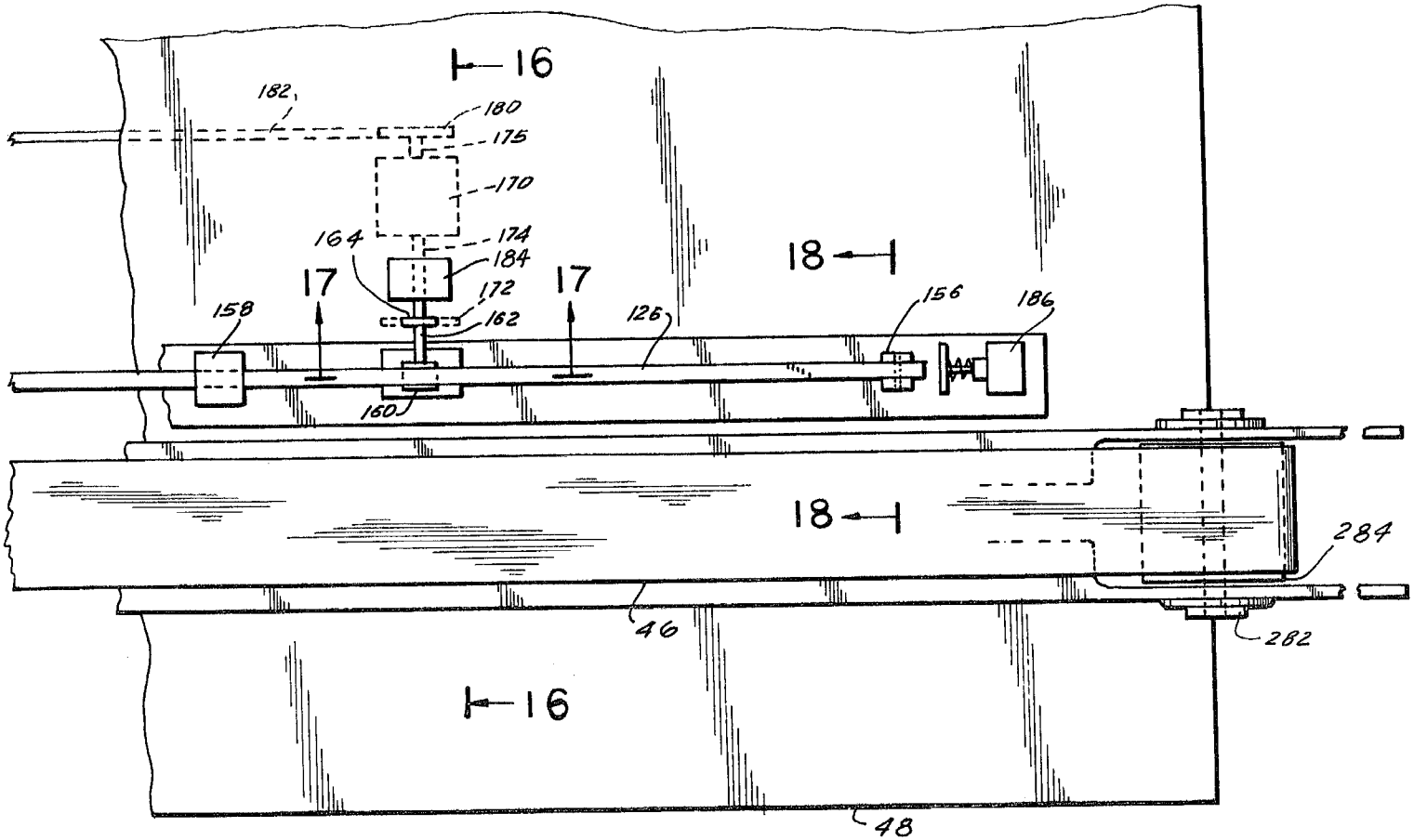
Figure 18:
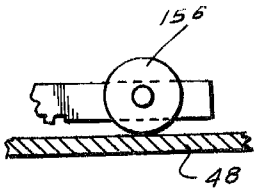
FIG. 18 depicts a sectional view of the rear roller arrangement for the rack.
Figure 17:
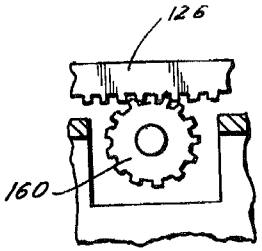
FIG. 17 depicts a sectional view of the rack and pinion engagement.
Figure 16:
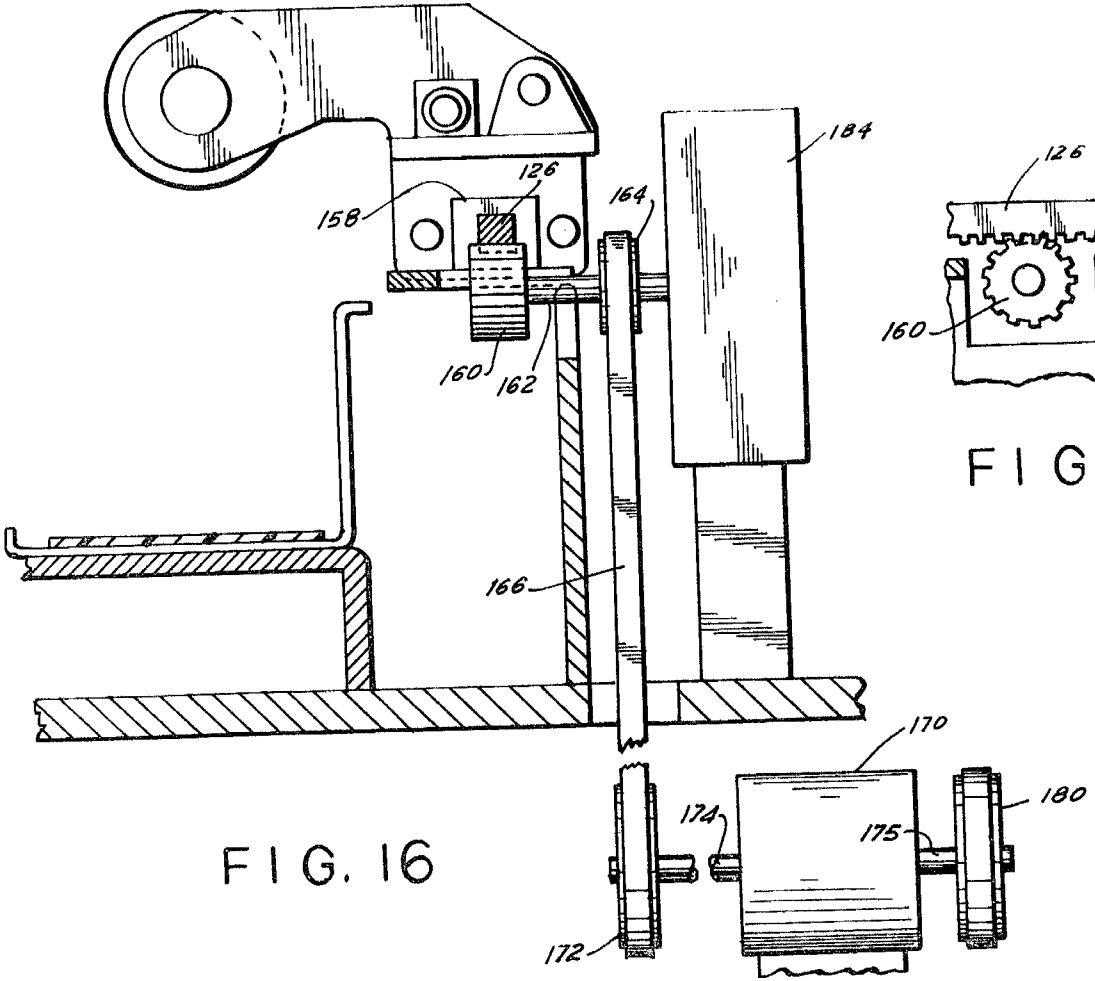
FIG. 16 depicts a sectional view of the linkage and rack and pinion arrangement as it connects to the carriage.

Referring now to FIGS. 15A and B in conjunction with FIG. 2B, the drive means for the various elements of the slicing machine are illustrated along with their interrelation with the clutches and the encoder assembly 184. A motor 190 is provided to drive the drums 56, 58, 60 and 62 which are mounted on shafts 192, 194, 196 and 198 respectively. A belt 200 is provided to drive the drums which engages a gear 202 located on the motor 190 with said belt engaging gears 204 and 206 located on shafts 192 and 194 respectively, and idler gear 208. Gear 208 is located on shaft 210 on which is also located gear 212. To convey drive to the drums 60 and 62, a gear 214 is provided and positioned on shaft 216. A belt 218 is positioned to engage gear 212 and 214 while being biased by an idler gear 220. This effectively transfers drive to the side of the channel to which drums 60 and 62 are located. An additional gear 222 is provided on shaft 216 which transfer a driving force to shaft 196 by way of belt 224 and gear 226 positioned on said shaft. This driving force is then capable of being transferred to drum 62 via gear 228 mounted on shaft 196, a gear 230 mounted on shaft 198 and a belt 231 between gears 228 and 230.

By such an arrangement, a driving force is transmitted equally to all drums and in addition drums 60 and 62 may be automatically moved so as to allow for the gripper to tilt up or down in the channel without an adjustment in the driving belts, with gears 208 and 220 provided to take up the slack in said driving belts 200 and 218. Also, the driving drums may be automatically adjusted by way of adjustable linkage 232 and 234 to vary the adjacent channel width in addition to being automatically adjusted by pneumatic, hydraulic or electrical means, shown as cylinders 236 and 238, which may be corporated into the system by any known means with control circuitry provided therefore. The cylinders 236 and 238 are attached to the adjustable linkages 232 and 234 respectively. The linkages 232 and 234 pivot off pins 240 and 242 and are connected to their respective shafts 196 and 198.

When the gripper is being tilted down into the channel, a signal may be sent by way of conventional circuitry to cylinder 238, thereby causing the linkage 234 to pivot, moving the shaft 198 and drum 62 away from the channel allowing the gripper to tilt down into a wide channel area. This is important when using oversized grippers. Once down, the cylinder 236 would return to its initial position, possibly by way of a signal originating at the encoder via conventional circuitry.

Similarly, cylinder 236 can be activated to move drum 60 when the gripper is being tilted up from its down position before retraction. The signals to cylinder 236 may also originate in the encoder.

Shaft 194 terminates in a gear box 244 which may be mounted on the underside of the table. A shaft 246 which interconnects with the gear box 244 is provided and has three gears 248, 250 and 252 thereon. These gears interconnect with corresponding gears 254, 256 and 258 via belts 260, 262 and 264 respectively. Each of the latter gears has a corresponding clutch 266, 268 and 270 which like the gears are mounted on shaft 272, which is rotationally mounted on the table 48. The function of these clutches is to provide the drive to the carriage. For example, clutch 268 provides 150% catch up drive. Clutch 270 provides 100% synchronized drive, and clutch 266 provides 250% retraction drive. All may be pneumatically, electrically etc. activated. As aforementioned, these percentages are relative to the drive of the drums and used merely as examples.

To complete the drive chain from motor 190, fixedly mounted gear 274 is provided on shaft 272 which conveys the rotation of said shaft to belt 182 which in turn is connected to clutch 170 which regulates movement of the rack and pinion and resulting carriage. If, perhaps 150% catch up drive and 100% synchronized drive is selected by the operator, when the trailing edge of the loaf has activated the product detector switch 70 which in turn activates the tilt mechanism to move the gripper from its up position to its down position in the channel, the clutch 268 would be activated, causing the shaft 272 to rotate at 150% of the drive, transferring this drive to the clutch 170 via gears 274, 180 and belt 182. This clutch would in turn ramp up initially this drive to the rack 126 and convey it thereto via the arrangement shown in FIG. 16 previously described.

When the gripper has moved a certain distance, approximately from the point of entering the channel to the pair of drums 56 and 60, the encoder 184, monitoring this movement, signals the clutch 270 to be activated, while deactivating clutch 268. This clutch 270 now provides in a similar manner drive for the gripper beyond this point at a speed synchronized with the drum feed speed. Also, the force of the 100% drive is ramped up by the clutch 170.

Since the feed at this point is synchronized with the drive of the motor 190, which is responsive to slice thickness control, this in turn is incorporated in the system to a point close to the knife.

If biasing or drag is desired at this point, the operator may select the desired amount by way of any conventional switching or potentiometer means connected to the clutch 170 which would during this time provide a drag in the feed to compensate for the pull of the knife.

In a similar fashion, clutch 266 would, upon completion of the slicing and once the gripper is in its raised position, utilize the motor 190 drive, which at this time is in high gear, bringing the second loaf to the blade as later discussed, to provide 250% retraction drive, returning the carriage to its initial position.

All of the aforementioned gears may be mounted on their respective shafts in any conventional manner with the shafts conventionally mounted on the support table to allow free rotation therebetween.

The drive for the conveyor 46 is provided by a variable speed drive motor 276 which drives said conveyor by way of shaft 278 and bearing surface 280. The opposite end of said conveyor is supported by shaft 282 and bearing surface 284, which allows free rotation of said conveyor about these elements. In the case of motors 190 and 276, they may be mounted onto the supporting table 48 in any conventional manner, and may be electrical in nature with their operation signaled by way of conventional circuitry.

Figure 4:
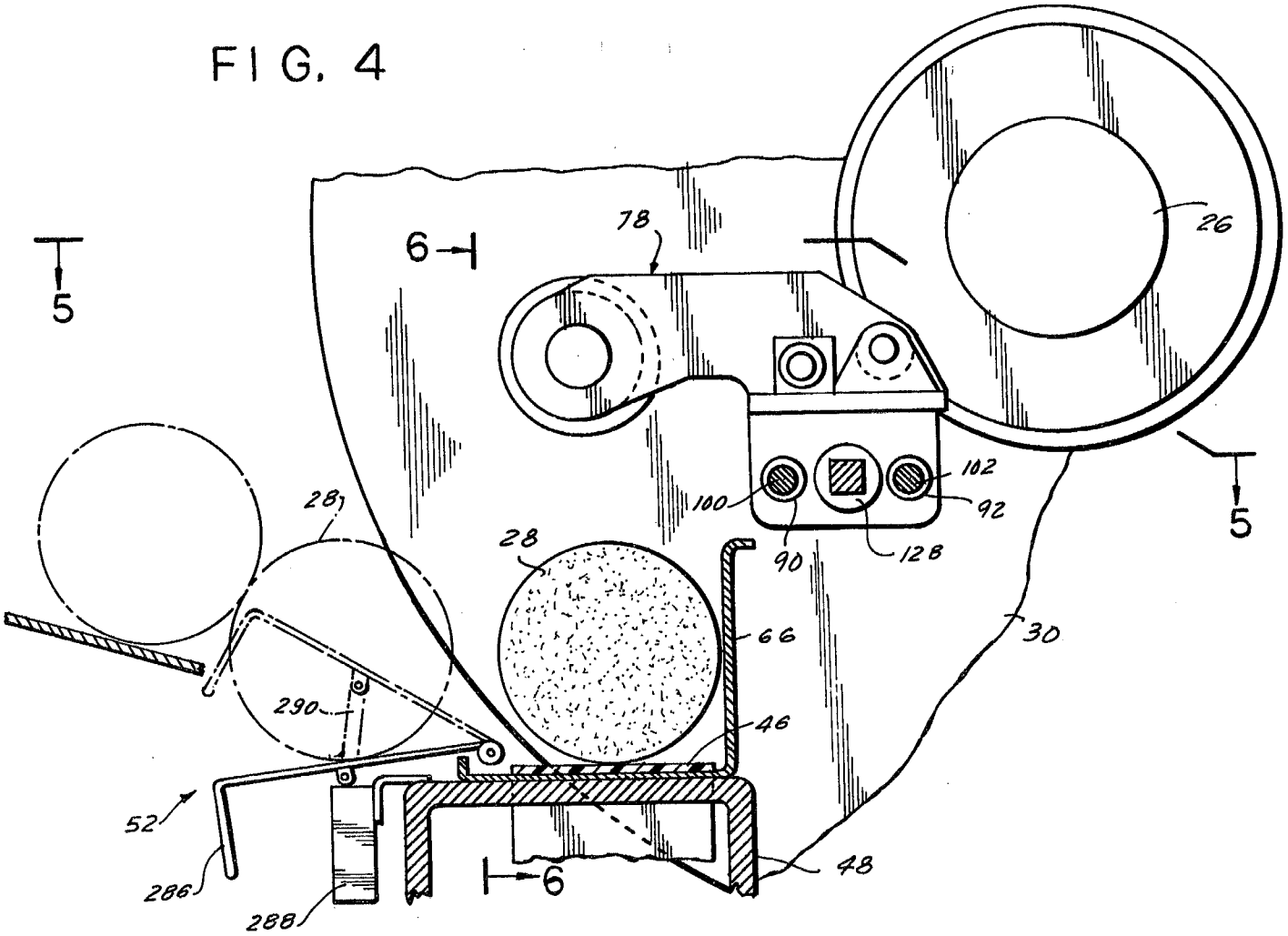
FIG. 4 is a sectional view along lines 4—4 of FIG. 2B depicting the carriage in its raised position.

As shown in FIG. 4, a ramp feed 52 is provided so as to allow a plurality of loaves 28 to be readied for feeding onto the conveyor 46. In this regard, a feed adjuster 286 is provided which is regulated by a cylinder 288 and piston 290. This cylinder 288 is capable of receiving a signal so as to allow the feed adjuster to move from its down position as shown which inhibits the feed of the loaf onto the conveyor, to a up position, which allows the loaf to move onto the conveyor in an abutting relationship with the channel wall 66. This allows only one loaf to pass onto the conveyor with the feed means 286 returning to its down position by way of the cylinder 288 and piston 290.

As clearly shown in FIGS. 8–13, a hold down device 292 is provided and may be affixed to the blade housing and/or channel wall 66. In this regard, the hold down devices is shown to be rotationally mounted on a bearing bolt 294 inserted in the side of the channel and when not engaging a loaf is in a normally lowered position. In its operating position, the hold down device would be spring loaded and serves to apply pressure to the tops of the loaf in the channel to aid in the prevention of rotation or undesired movement of the loaf during slicing. A device of this nature and its operation is disclosed in U.S. Pat. No. 4,015,494 aforenoted, and said device is readily incorporated in this system.

In addition, a gate or guard 296 is provided, and may be spring loaded and rotationally mounted at the end of channel wall 72, so that the gate extension 298 extends into the channel which when a loaf is not being sliced is perpendicular to the channel wall, inhibiting accidental placement of hands etc. near the blade. Also, as the loaf is being sliced because it is spring loaded, it serves to aid in maintaining the position of the loaf in the center of the channel. In the case of the hold down device, and the gate, rather than spring loading them, operation may be made by pneumatic, hydraulic or electric means regulating their operation.

OPERATION OF THE SLICING MACHINE

With regard to the operation of the slicing machine particular reference is now directed again to FIGS. 8–14. With regard to FIG. 10, the initial starting position of the system is shown. In this regard, the cylinder 288 is signaled to allow a loaf of product to be sliced, designated by Roman Numeral I with subsequent loaves designated similarly in succeeding order, with loaf I shown to be on conveyor 46 which is now proceeding to drive loaf I towards the blade. This signal may originate with a start button, or any other type of conventional circuitry, turning the machine on, including the motor 190 for driving the drums and gripper assembly and motor 276 for driving the conveyor. The gripper and carriage is in its up position so as to allow loaf I to pass thereunder, tripping the product detector switch 70. When the gripper and carriage is in the up position, the motor 190, which is variable speed, operates at an increased speed to drive loaf I quickly into the slicing position.

When the loaf is adjacent the blade, which is determined by the number rotation of the drums, and ready to be sliced, motor 190 by way of conventional circuitry is signalled to decrease the drive speed to an initial prearranged speed for conventional slicing. At this juncture, the profile compensation control system as disclosed in the aforementioned application Ser. No. 092,195 could be engaged to compensate for tapers at the front end of the loaf. Thereafter, as discussed in said application and aforementioned patents, signals from the weighing apparatus 10 would be utilized to control slice thickness by regulating the speed of the motor 190 and corresponding feed of the loaf into the blade.

Figure 11:
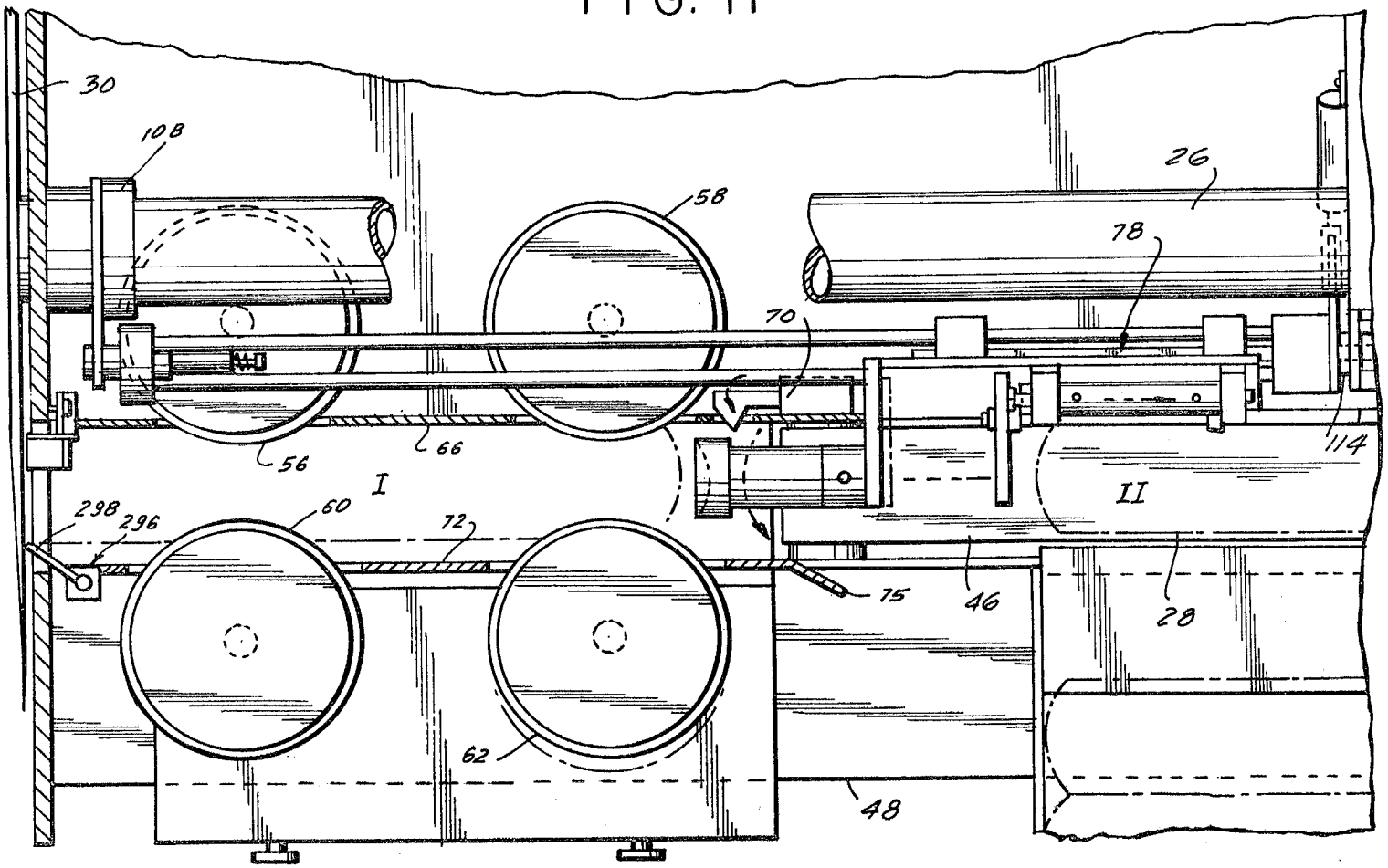

Heretofore the usual feed of the product into the blade had been by way of a conveyor running the length of the channel bed with vertical hold down means to assist in controlling the feed of the product, compensating against any pull resulting from the turn of the knife. However, through the use of the drums which may have ribs about their periphery as aforementioned, this horizontal driving force effectively controls the feed of the product to a point relatively close to the blade, with the gripper and carriage gripping the tail end of the loaf the remaining distance. In this regard, as shown in FIG. 11, the drums are effectively gripping loaf I with the tail end of the loaf is shown to have passed the product detector switch 70. The cylinder 116 is now signaled by said switch or via control circuitry, to tilt the carriage into its downward position, with the suction cup 80 now located in the channel 50. Contemporaneously, and from the same source, cylinder 238 is activated and moves the drum 62 out of the channel, so as to allow the gripper to enter the channel, particularly when using the larger claw gripper. Upon completion of the tilting, it returns the drum to its operational position, (drum movement is shown in FIG. 11). At this point, the cylinder 288 has been signaled to allow loaf II to enter the channel which is now resting on conveyor 46. In addition, the pusher 140 has been pulled back away from the suction cup by way of a signal transmitted to the cylinder 142, again, which may eminate from control circuitry which is signaled by the rear limit switch, with said circuitry also providing a signal to the cylinder 288. This may also signal the application of a vacuum to the suction cup with such vacuum arrangement well known in the art.

Figure 12:
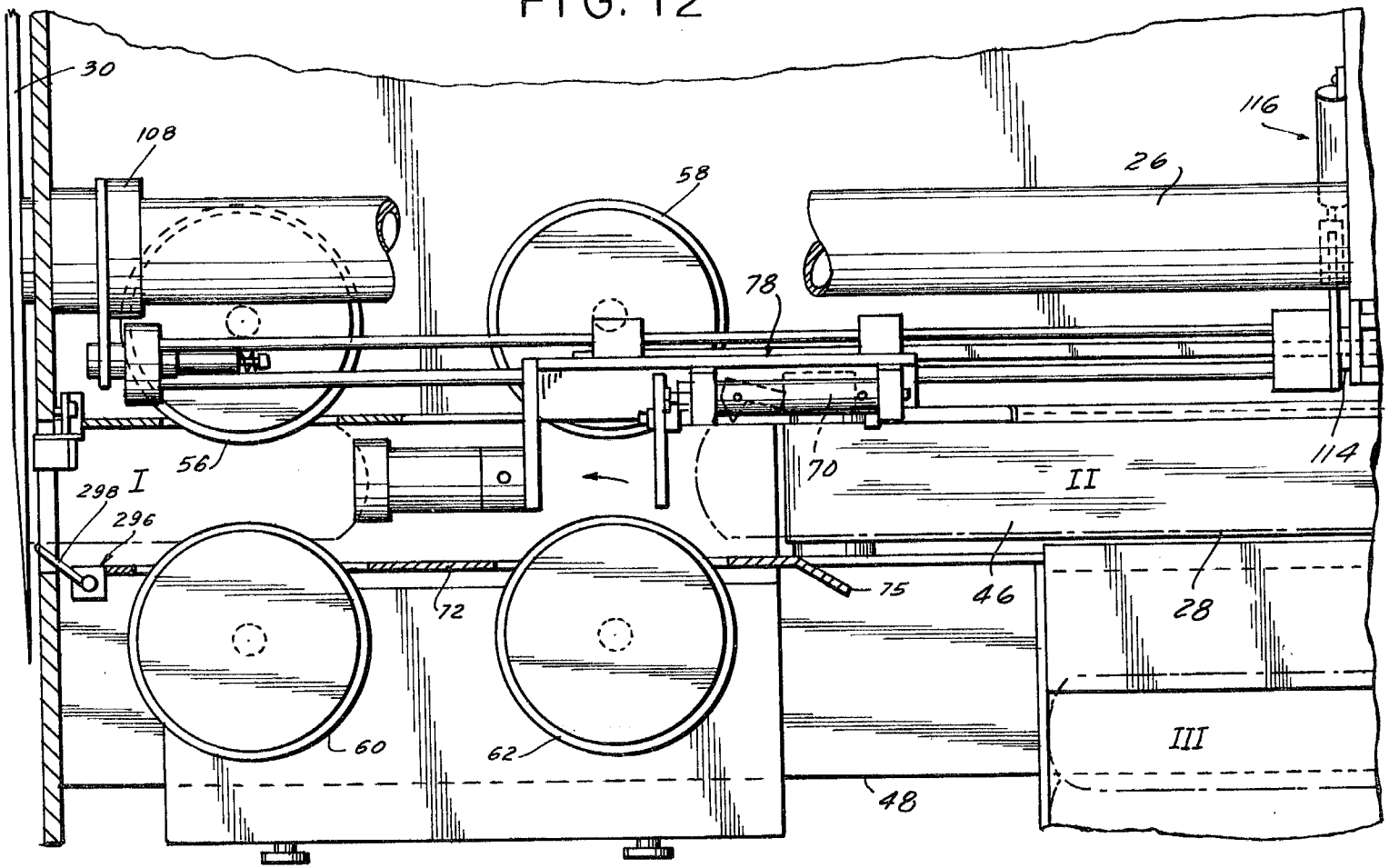

As previously discussed, the carriage is now driven by the clutch arrangement quickly toward the trailing end of loaf I. The gripper will catch up to said end approximately when the forward end of the gripper is about equidistant between the forward pair and rear pair of drums 56 and 60, 58 and 62 respectively. This point is shown in FIG. 12, and at this time, if perhaps the 100% clutch and biasing has been selected, these will come into play as desired in driving the loaf the remaining distance from drums 56 and 60 to the blade compensating for blade pull and providing incorporation of slice thickness control.

All during this time, the encoder 184 has been monitoring the position of the carriage via the rack and pinion arrangement and at proscribed points activate the appropriate clutches by way of conventional circuitry.

Also, as the gripper and consequently the tail end of loaf I approaches the blade, at a predetermined position the profile compensation control system may be activated to compensate for taper on the rear end of the loaf to be sliced as disclosed in the aforenoted application Ser. No. 092,195; since its distance from the blade is determinable from the encoder which would provide such a signal to that system.

Figure 8:
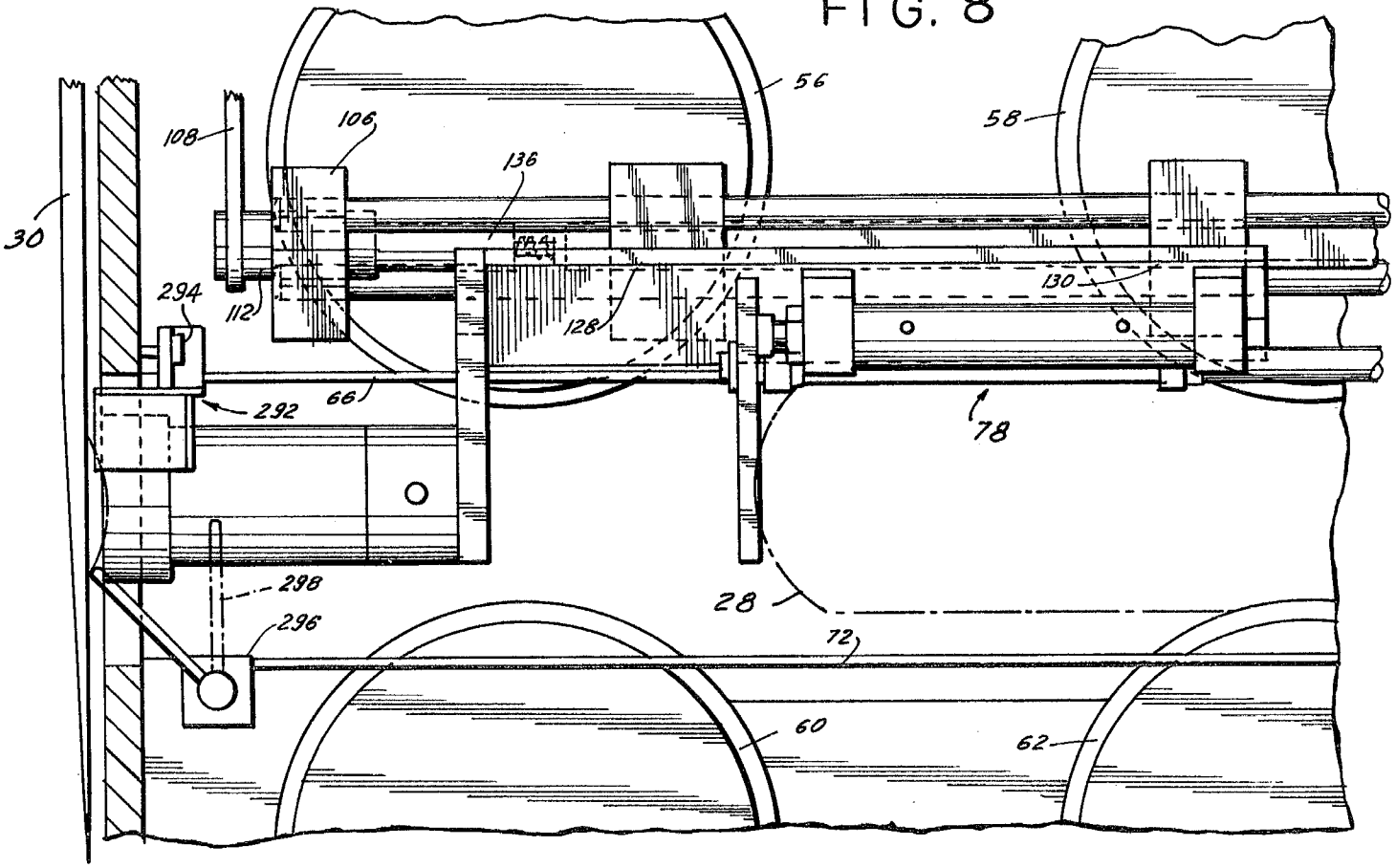
FIG. 8 is a horizontal sectional view along lines 8—8 of FIG. 7 with the carriage shown in its lowered and forward position.
Figure 9:
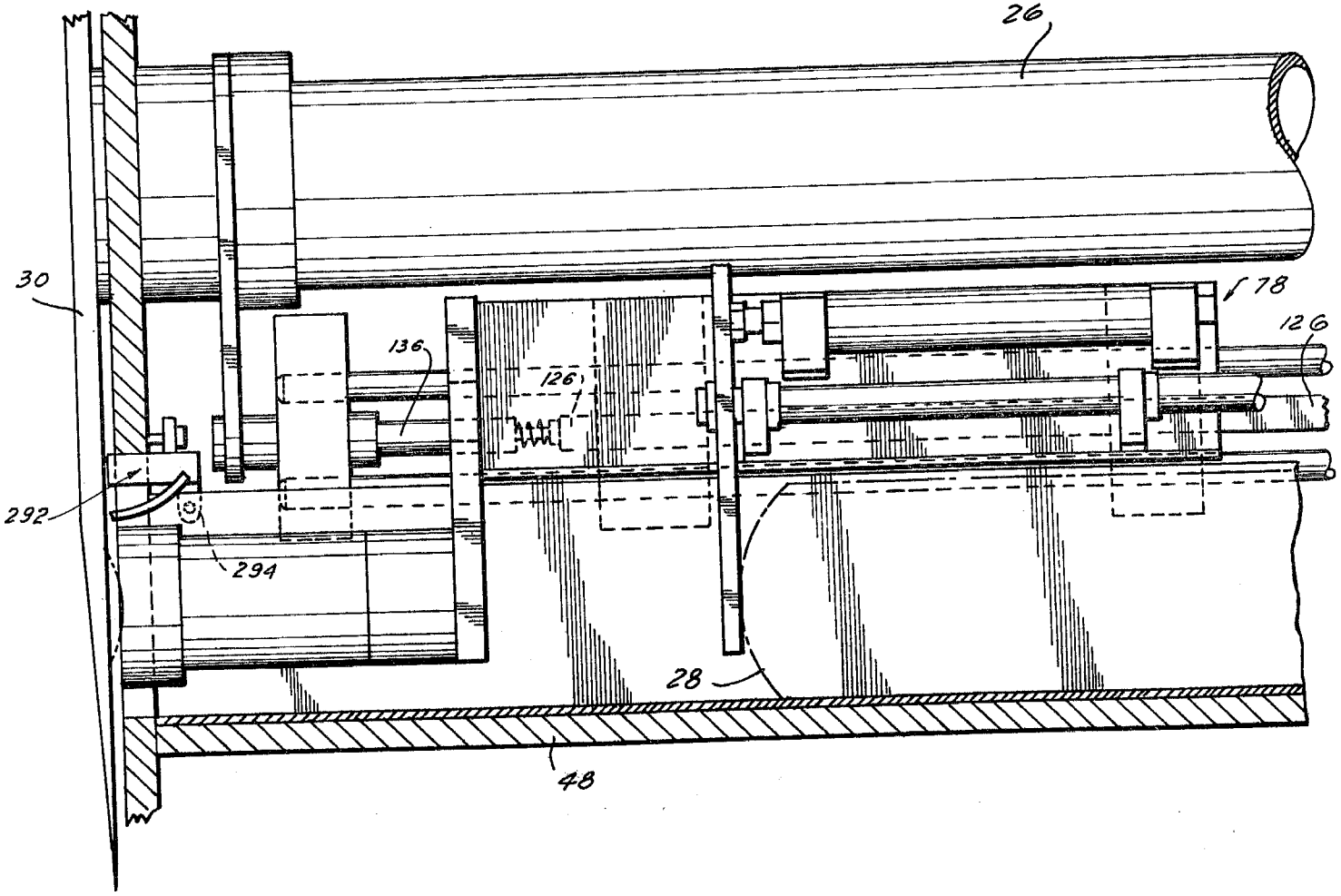
FIG. 9 is a vertical sectional view along lines 9—9 of FIG. 7 with the carriage shown in its lowered and forward position.
Figure 13:
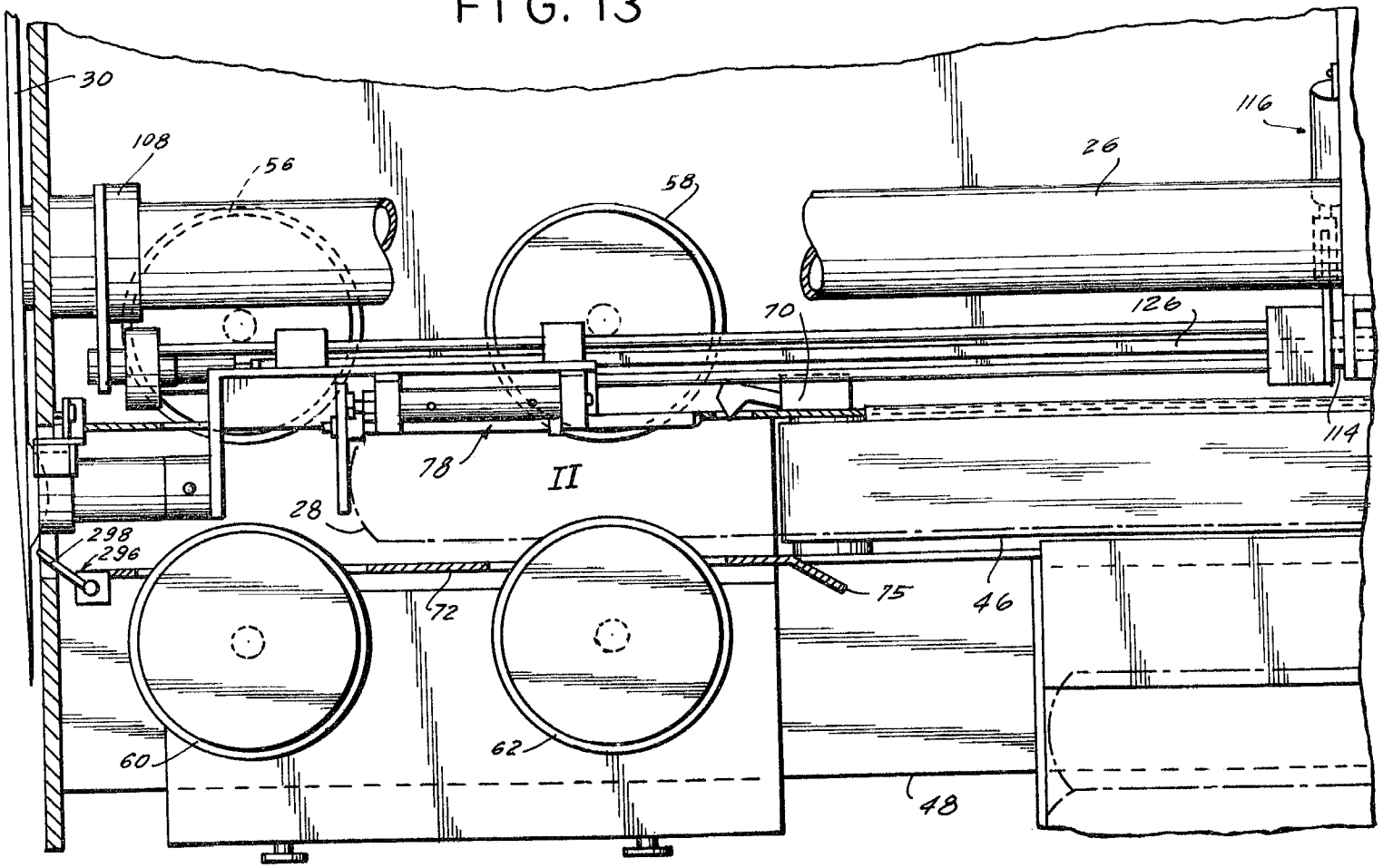

As shown in FIG. 13, when the gripper is approximately ½ inch from the knife, the rack 126 engages the stop 136, (horizontal and vertical view of the carriage and gripper in this position is shown most clearly in FIGS. 8 and 9). At this point, a signal may be sent from the encoder to the control circuitry indicating that the gripper has reached this point. In the alternative, the forward fix stop may also be provided with a limit switch which would send a similar signal to the control circuitry. In either case, when the signal is received, a signal is sent from the control circuitry stopping the drive of motors 190 and 276.

Figure 14:
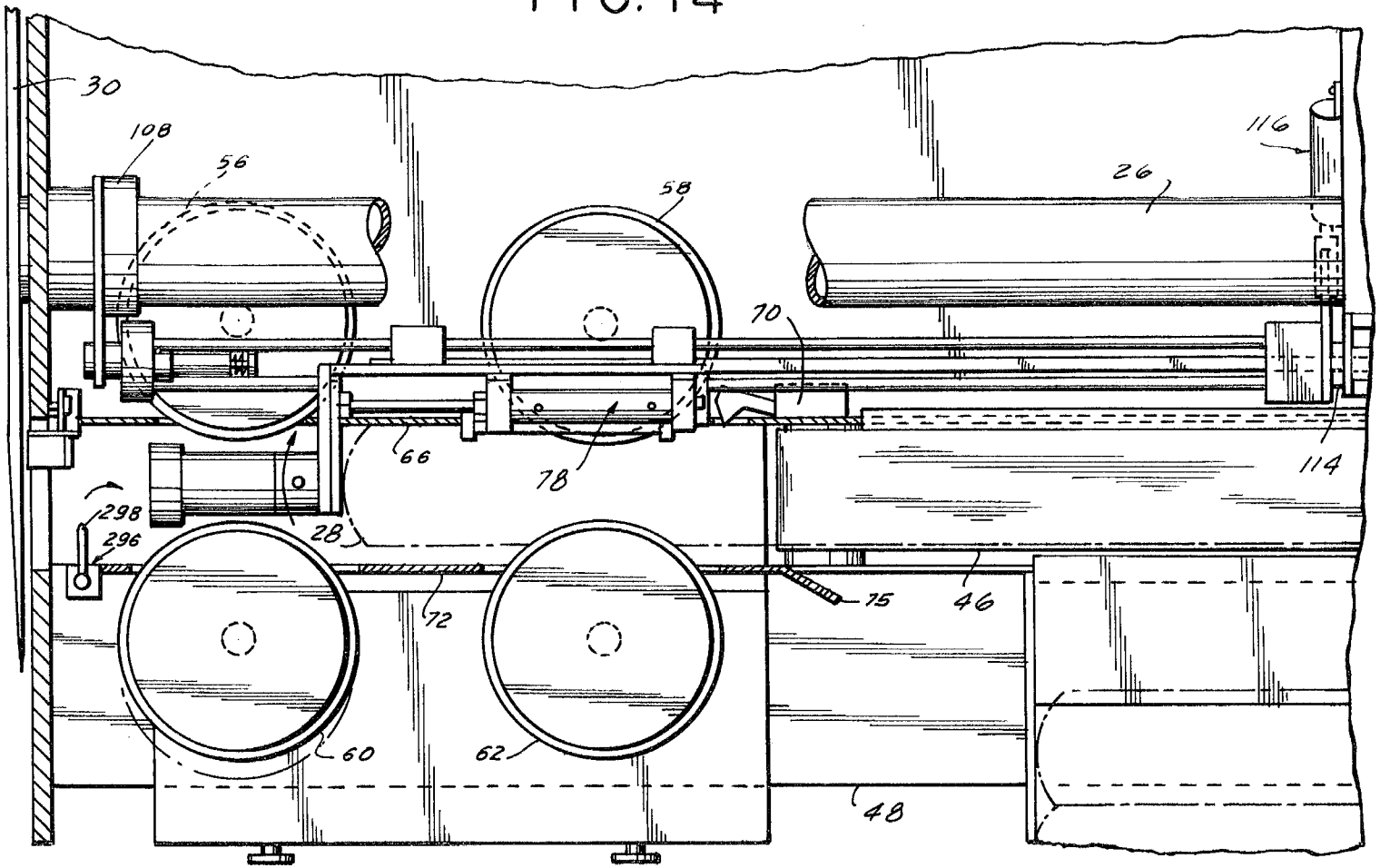

A signal is now sent from the control circuitry which result in cylinder 142 pushing the carriage gripper and back approximately 4 inches back off the blade, with said movement being monitored by the encoder which may then eminate a signal to the control circuitry which could then signal the cylinders 118 and 236 to tilt the carriage and gripper from its down position to its up position and move drum 56 away from the channel as shown in FIG. 14. The foregoing retraction and tilting of the carriage and gripper takes approximately 3 seconds and at the inception of the signal to stop the motors 190 and 276, a signal could also be sent to the weighing apparatus 10 allowing for the tare correction to take place, as disclosed in Application Ser. No. 092,195 aforementioned thereby utilizing all of the available system operating time.

Figure 10:
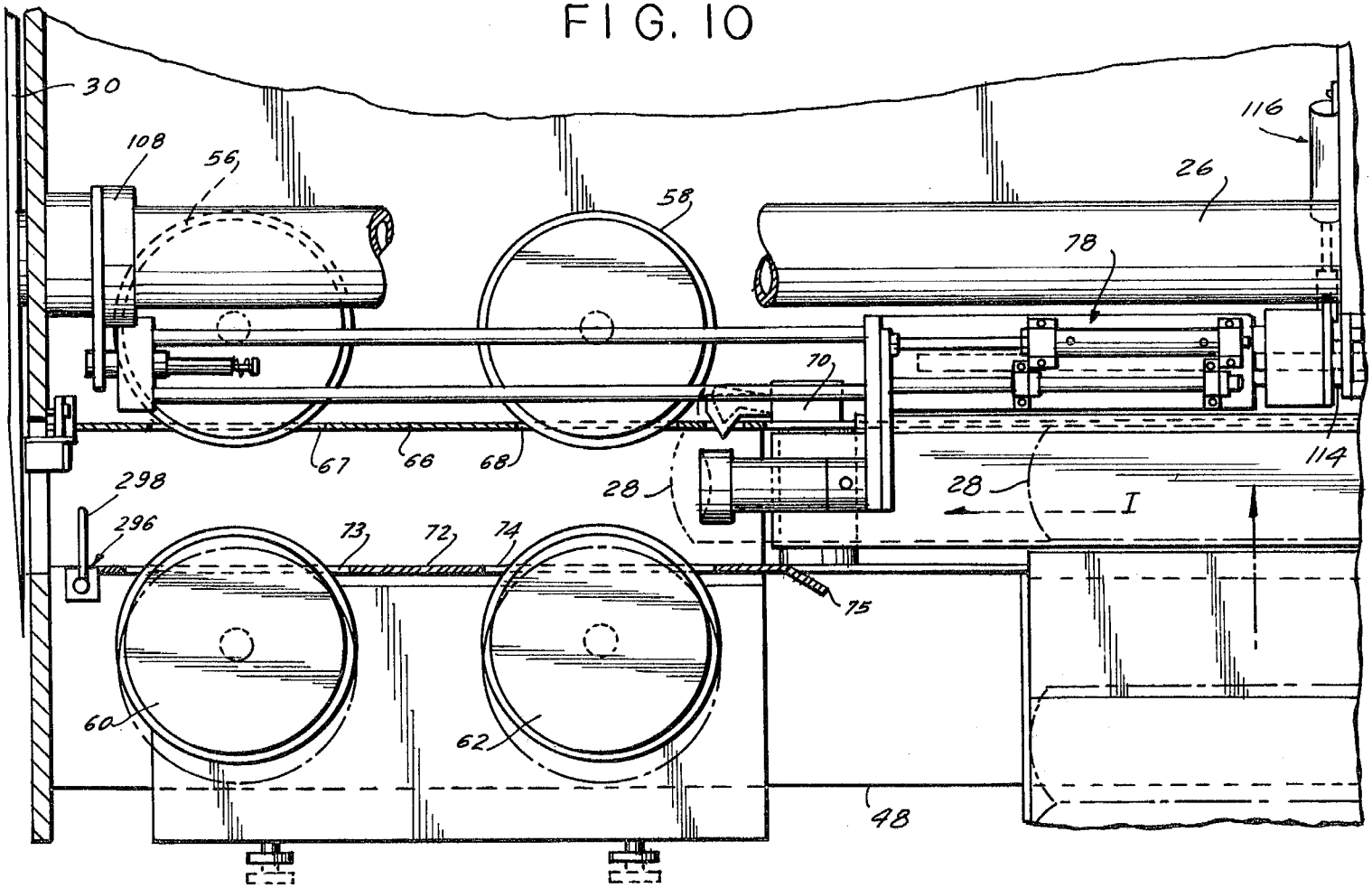
FIGS. 10–14 depicts plan sectional view of the sequence of operation of the elements of the system as the loaves are fed into the slicing blade.

Once the carriage and suction cup has been lifted out the channel 50 the motors 190 and 276 are activated, with the motor 190 driving at a fast rate of speed so that the loaf II is placed into a slicing position as quickly as possible. At this point the carriage is now in its up position and the reverse clutch 266 may be signaled, by way of the control circuitry, to retract the carriage to its initial starting position as shown in FIG. 10. The foregoing sequence now repeats itself so that the system is in continuous operation, with somewhat continuous slicing of the product taking place.

While it has been mentioned on numerous occasions that standard control circuitry may be utilized in regulating the operation of various elements of the system as signaled by the product detector switch 70 and the encoder arrangement, it should be understood that this could also include conventional pneumatic or hydraulic arrangements which may be activated and deactivated accordingly by way of such control circuitry. The encoder utilized in the system may be of conventional design possibly functioning by way of a change in voltage output related to displacement of a potentiometer, which in turn would indicate the position of the gripper and carriage during all phases of the operation of the machine, and which signals may then be utilized by the control circuitry, as discussed in the application entitled Continuous Cold Cut Slicing Machine filed herewith. Also, during this time, as disclosed in the aforenoted patents, the vacuum to the suction cup or pressure to the claw gripper when either is in the up position may be discontinued, allowing for the end piece of butt of the loaf contained thereon to be ejected.

While a somewhat preferred embodiment of the present invention has been disclosed and discussed in detail herein; it should be understood that the scope of the invention should not be limited thereby, and said scope should be determined by that of the appended claims.

What is claimed:

1. A combination of a slicing machine having a slicing blade for slicing a loaf of product having a front and rear end; a first feed means for feeding said loaf into said blade; a control means for determining the rate of feed of the product by the first feed means towards the blade and consequently controlling slice thickness; a second feed means for feeding a loaf towards the blade when said loaf becomes disengaged from said first feed means during slicing operation which includes a gripper means for engaging the rear end of the loaf; a clutch means connected to said control means; a drive means connected to said second feed means and said clutch means so as to allow the driving of the second feed means by the clutch means in conjunction with the control means towards the blade during slicing of the loaf, and away from the blade upon completion of the slicing; and said clutch means also capable of providing drag on the second feed means during slicing of the loaf beyond the first feed means adjacent the blade to compensate for the pull of the blade.

2. The combination in accordance with claim 1 wherein said first feed means includes a plurality of rotating drums adjacent said blade; said control means includes a variable speed motor and adapted to receive signals which result in a change in the motor speed; wherein said drums engage the loaf with the rate of rotation of the drums and consequently the feed of the product towards the blade is controlled by said motor.

3. The combination in accordance with claim 2 wherein the drive means includes a rack attached to said gripper means, said rack engages a pinion which is coupled with the clutch means so as to regulate movement of the gripper means.

4. The combination in accordance with claim 3 wherein the pinion is coupled with an monitor means capable of monitoring the movement of the gripper means by way of rotational displacement of the pinion and capable of activating said clutch means at predetermined positions of said gripper means.

5. The combination in accordance with claim 4 wherein said clutch means includes a plurality of clutches with a first clutch coupled with the pinion; a second clutch adapted to receive drive and convey it to the first clutch to retract the gripper means upon completion of slicing; and a third clutch adapted to receive drive and convey it to the first clutch to provide positive drive of the gripper means towards the blade during slicing of the loaf.

6. The combination in accordance with claim 5 wherein the positive drive provides the driving of the gripper means at a speed sychronized with the speed of the feed of the first feed means.

7. The combination in accordance with claim 5 further including a fourth clutch adapted to receive drive and convey it to the first clutch to provide a positive drive of the gripper means towards the blade at an increased rate of that provided by the third clutch during a period prior to said gripper means engagement with the rear end of the loaf being sliced.

8. The combination in accordance with claim 5 wherein the first clutch is of a magnetic particle type capable of ramping up and down the torque transferred to it from the other clutches.

9. The combination in accordance with claims 2 or 7 which includes a belt conveyor which feeds the loaf towards the blade, said conveyor is located on said slicing machine, rearward of said drums, and operates to drive the loaf into engagement with said drums.

10. The combination in accordance with claim 9 which further includes a holding means for holding a plurality of loaves, with said holding means capable of being activated so as to periodically feed a loaf onto said belt conveyor.

11. The combination in accordance with claim 10 including a rear indicating means or product detector switch located between the drums and the conveyor and operatively connected to said motor, wherein in operation of the slicing machine, a loaf is fed onto the belt conveyor by the holding means, said conveyor drives said loaf into engagement with said rear indicating means and then to said drums, said rear indicating means is adapted to signal said motor causing a feed of product towards the blade at a first rate of speed until adjacent the blade, at which time the motor feeds the loaf into the blade at a second speed responsive to slice thickness control.

12. The combination in accordance with claim 11 which includes a tilt means capable of moving the second feed means between a first and a second position, said tilt means being operatively connected to the rear indicating means and responsive to a signal eminating therefrom; said holding means also being operatively connected to said rear indicating means and being responsive to a signal eminating therefrom; wherein at the beginning of operation of said slicing machine the second feed means is in its first position with the gripper means located somewhat adjacent said rear indicating means, and when the rear end of the loaf has passed said rear indicating means, said means signals said tilt mechanism and said holding means, with the tilt mechanism then moving the second feed means from its first to its second position, and said clutch means providing positive drive of the gripper means towards the blade with the holding means allowing a second loaf to pass onto the conveyor which then drives the second loaf towards the blade.

13. The combination in accordance with claim 12 wherein said monitoring means operatively connected to said tilt means and said second feed means and adapted to provide signals thereto, the second feed means being capable of retracting said gripper means away from the blade so as to allow the second feed means to move from the second position to the first position upon completion of slicing of the first loaf; wherein, in operation, upon completion of the slicing of the first loaf, the monitoring means signals the second feed means to retract the gripper means and signals the tilt means to move the second feed means from the second position to the first position.

14. The combination in accordance with claim 13 wherein said monitoring means is connected to the clutch means and adapted to provide signals thereto, wherein when said second feed means is moved from the second position to the first position, the monitoring means signals the clutch means to retract the second feed means to its position at the beginning of operation.

15. The combination in accordance with claim 14 wherein the monitoring means is adapted to provide signals based upon the position of the gripper means to the clutch means during the drive of the gripper means towards the blade wherein, during operation, immediately after second feed means is moved from its first position to the second position, the monitoring means signals the clutch means to drive the gripper means towards the blade at a first speed; and at a predetermined point, at a second speed, which is sychronized with the speed of the feed of the first feed means.

16. The combination in accordance with claim 15 wherein the predetermined point is when the gripper means has passed beyond the drums while being driven towards the blade.

17. The combination in accordance with claim 15 wherein the monitoring means also signals the clutch means to provide drag when the gripper means is being driven towards the blade at the second speed.

18. The combination in accordance with claim 1 which further includes a monitoring means capable of signalling a weighing apparatus to compensate for tare.

19. The combination in accordance with claim 17 wherein said monitoring means is capable of signalling a weighing apparatus to compensate for tare.

20. The combination in accordance with claim 18 wherein said monitoring means is capable of signalling said weighing apparatus when the second feed means is being retracted away from the slicing blade.

21. The combination in accordance with claim 19 wherein said monitoring means is capable of signalling said weighing apparatus when the second feed means is being retracted away from the slicing blade.

22. The combination in accordance with claims 1, 18 or 20 which further includes a monitoring means capable of providing an output utilizable in engaging a profile compensation system.

23. The combination in accordance with claims 19 or 21 wherein said monitoring means is capable of providing an output utilizable in engaging a profile compensation system.

24. The combination in accordance with claim 13 which includes a means of moving at least one drum in a direction perpendicular to and away from the gripper means when it moves from its first position to its second position and when it moves from its second position to its first position.

25. The combination in accordance with claim 6 wherein the first and third clutch are capable of providing 100% positive drive of the gripper means towards the blade.

* * * * *

UNITED STATES PATENT AND TRADEMARK OFFICE

CERTIFICATE OF CORRECTION

PATENT NO. : 4,309,927

DATED : January 12, 1982

INVENTOR(S) : Edmund G. Dennis & Oscar W. Dillon

It is certified that error appears in the above—identified patent and that said Letters Patent is hereby corrected as shown below:

Column 3, line 62, change "Figs." to --Fig.--;

Column 6, line 10, delete "us";

Column 6, line 33, change "eminating" to --emanating--;

Column 11, line 50, change "a" to --an--;

Column 12, line 59, delete "is";

Column 13, line 6, change "eminate" to --emanate--;

Column 13, line 26, change "proscribed" to --prescribed--;

Column 13, line 49, change "result" to --results--;

Column 13, line 52, change "eminate" to --emanate--;

Column 15, line 54, change "eminating" to --emanating--;

Column 15, line 57, change "eminating" to --emanating--.

Signed and Sealed this

*Seventh* Day of *September 1982*

[SEAL]

*Attest:*

GERALD J. MOSSINGHOFF

*Attesting Officer*

*Commissioner of Patents and Trademarks*